United States Patent [19]

Abe et al.

[11] Patent Number: 4,717,647

[45] Date of Patent: Jan. 5, 1988

[54] METHOD FOR PROCESSING SILVER HALIDE PHOTOGRAPHIC ELEMENTS IN A BLEACHING BATH AND A BLIXING BATH

[75] Inventors: Akira Abe, Sayama; Junya Nakajima, Minami-ashigara, both of Japan

[73] Assignee: Fuji Photo Film Co., Ltd., Minami-ashigara, Japan

[21] Appl. No.: 775,527

[22] Filed: Sep. 13, 1985

[30] Foreign Application Priority Data

Sep. 21, 1984 [JP] Japan ..... 59-198197
Sep. 21, 1984 [JP] Japan ..... 59-198198

[51] Int. Cl.[4] ..... G03C 5/38; G03C 5/44; G03C 7/34; G03C 7/26

[52] U.S. Cl. ..... 430/393; 430/385; 430/421; 430/430; 430/460; 430/461; 430/552; 430/553

[58] Field of Search ..... 430/421, 430, 460, 461, 430/393, 384, 385, 552, 553

[56] References Cited

U.S. PATENT DOCUMENTS

| | | | |
|---|---|---|---|
| 3,809,563 | 5/1974 | Nimura et al. | 430/460 X |
| 3,893,858 | 7/1975 | Wabnitz, Jr. | 430/425 |
| 4,040,837 | 8/1977 | Sakamoto et al. | 430/379 X |
| 4,144,068 | 3/1979 | Ishibashi et al. | 430/425 |
| 4,169,733 | 10/1979 | Iytaka et al. | 430/425 |
| 4,518,680 | 5/1985 | Koboshi et al. | 430/385 |

FOREIGN PATENT DOCUMENTS 1394357 5/1975 United Kingdom .

*Primary Examiner*—John E. Kittle
*Assistant Examiner*—Mukund J. Shah
*Attorney, Agent, or Firm*—Burns, Doane, Swecker & Mathis

[57] ABSTRACT

A method for the processing of a silver halide color photographic element comprising imagewise exposing the element, color developing the exposed element, followed by de-silvering, characterized in that the de-silvering step comprises processing the developed element in a bleaching bath containing an aminopolycarboxylic acid ferric ion complex salt and subsequently in a blixing bath containing an aminopolycarboxylic acid ferric ion complex salt and a fixing agent.

14 Claims, No Drawings

METHOD FOR PROCESSING SILVER HALIDE PHOTOGRAPHIC ELEMENTS IN A BLEACHING BATH AND A BLIXING BATH

BACKGROUND OF THE INVENTION

(1) FIELD OF THE INVENTION

This invention relates to a method for processing of imagewise exposed color photographic light-sensitive elements containing silver halide (hereinafter, referred to as "color photographic elements") and more particularly, to an improved photographic process which enables sufficient de-silvering in a shortened time and produces good quality color reproductions.

(2) DESCRIPTION OF THE PRIOR ART

Basic processes for processing color photographic elements generally include a color development step and desilvering step. In the color development, imagewise exposed silver halide is reduced by a color developing agent to form metallic silver and the oxidized color developing agent reacts with a coupler (or dye forming agent) to form a color image. In the subsequent de-silvering step, the metallic silver formed in the color development is oxidized by an oxidizing agent (generally called "a bleaching agent") and the oxidized silver is then dissolved by a silver ion complexing agent generally called a fixing agent. This de-silvering step essentially leaves a dye image on the color photographic elements.

The de-silvering step is done with either a bleaching bath containing a bleaching agent followed by a fixing bath containing a fixing agent or a single bleach-fixing bath (or blixing bath) containing both bleaching and fixing agents.

In addition to these basic steps, the actual procedures of color development processes include various additional steps such as a hardening step, a stopping step, a stabilizing step and a washing step, so as to obtain a dye image having a better photographic and physical quality and a longer stability of the dye image.

Ferricyanides, dichromates, ferric chloride, aminopolycarboxylic acid ferric ion complex salts and persulfates are generally known as the bleaching agent.

However, ferricyanides and dichromates are liable to cause environmental pollution and the use thereof requires special equipment for the treatment of such chemicals. Ferric chloride has various problems in practical use. For example, it forms ferric hydroxide and produces stains in a subsequent washing step. Persulfates have disadvantages in that they are very weak in bleaching power and therefore require an extremely long time for bleaching. In this connection, there has been proposed a method for improving the bleaching power of persulfates by using them together with a bleach accelerator. However, this method is not practical because the use and storage of persulfates are controlled by Fire Prevention Law and consequently require special facilities.

Aminopolycarboxylic acid ferric ion complex salts (or ferric salts of an aminopolycarboxylic acid), particularly ethylenediaminetetraacetic acid ferric ion complex salts (or ferric salts of ethylenediaminetetraaacetic acid) are the bleaching agents most widely used at present because, unlike persulfates, they have few problems regarding environmental pollution and storage. However, the bleaching power of the aminopolycarboxylic acid ferric ion complex salts is not always sufficient. The complex salts may attain the desired de-silvering when they are used to bleach or bleach-fix a low-speed silver halide color photographic element mainly containing silver chlorobromide emulsion, while the complex salts cannot achieve sufficient de-silvering or they need a long time for bleaching when they are used to process a high-speed color photographic element mainly containing silver bromoiodide or silver bromochloroiodide emulsion and having been spectrally-sensitized, especially a color reversal photographic material or a color negative photographic material containing an emulsion of high silver content.

For example, the bleaching time of the photographic color negative light-sensitive material in the bleach bath of the aminopolycarboxylic acid ferric ion complex salt is at least four minutes and it is necessary to take troublesome precautions such as pH control or aeration in order to maintain the bleaching power at the desired level. Even if such precautions are taken, it is not rare that de-silvering is not carried out sufficiently.

For the purpose of complete de-silvering, it is further necessary to treat the element in fixing bath for at least three minutes following the bleaching bath. Accordingly, there is a strong need to shorten the time for de-silvering.

For accelerating the de-silvering, there is known a bleach-fixing solution, as disclosed in German Pat. No. 866,605, which contains both aminopolycarboxylic acid ferric ion complex salt and thiosulfate. However, the bleaching power of this solution is very weak because the blixing solution contains aminopolycarboxylic acid ferric ion complex salt which is weak in oxidizing power (or bleaching power) and thiosulfate which has a reducing power. It is, therefore, very difficult for this blixing solution to attain the desilvering of a photographic color light-sensitive material of high speed and high silver content and consequently, this blixing solution cannot be employed for practical use. Many attempts have been made to overcome these disadvantages of the blixing solution. Examples of such attempts include the addition of iodides or bromides thereto as disclosed in British Patent No. 926, 569 or Japanese Patent Publication No. 11,854/1978 (U.S. Pat. No. 4,040,837) and the incorporation of a high concentration of aminopolycarboxylic acid ferric ion complex salt thereto using triethanolamine as disclosed in Japanese Patent Public Disclosure No. 95,834/1973. However, none of these methods has sufficient effect for practical use.

In addition to its poor de-silvering ability, the blixing solution has another serious drawback in that it reduces the cyan dye formed by color development to the leuco dye and consequently, interferes with color reproduction. It is known that this drawback can be reduced by elevating the pH value of the blixing solution as disclosed in U.S. Pat. No. 3,773,510. This method is, however, almost useless from a practical point of view because the elevation of the pH value results in the weakening of the bleaching power of the solution. U.S. Pat. No. 3,189,452 discloses a method wherein, after blixing, the leuco dye is oxidized to the cyan dye by a ferricyanide bleaching solution. But the use of the ferricyanide brings about the problem of environmental pollution and the bleaching after the blixing has almost no effect on the decrease in the remaining silver ciontent.

As an alternative method for increasing the bleaching power of the aminopolycarboxylic acid ferric ion complex salt, there has been proposed a method wherein various bleaching accelerators are added to the bleaching bath, the blixing bath or the preceding bath.

Examples of such accelerators include various mercapto compounds as disclosed in U.S. Pat. No. 3,893,858, British Pat. No. 138,842 and Japanese Patent Public Disclosure No. 141,623/1978; compounds having disulfide linkage as disclosed in Japanese Patent Public Disclosure No. 95,630/1978 (U.S. Pat. No. 4,169,733); thiazolidine derivatives as disclosed in Japanese Patent Publication No. 9,854/1978; isothiourea derivatives as disclosed in Japanese Patent Public Disclosure No. 94,927/1978 (U.S. Pat. No. 4,144,068); thiourea derivatives as disclosed in Japanese Patent Publication Nos. 8506/1970 (U.S. Pat. No. 3,617,283) and 26,586/1974 (U.S. Pat. No. 3,809,563); thioamide compounds as disclosed in Japanese Patent Public Disclosure No. 42,349/1974 (GB No. 1,394,357); and, dithiocarbamic acid salts as disclosed in Japanese Patent Public Disclosure No. 26,506/1980.

Although some of these accelerators do in fact have a bleach accelerating effect, the effect is, however, not sufficient to meet the need for shortening of the processing time.

SUMMARY OF THE INVENTION

A first object of this invention is to provide a method for the processing of a color photographic element, especially one of high-speed and high silver content, which enables sufficient de-silvering of the element in a shortened time and produces good quality color reproductions.

A second object of this invention is to provide a method for the processing of a color photographic element, which gives rise to few or no problems of environmental pollution or storage of chemicals to be used therein so that the method can easily be put to practical use.

The inventors of this invention found that the objects of this invention can be attained by subjecting an imagewise exposed color photographic element to a color development, processing the developed element in a bleaching bath containing an aminopolycarboxylic acid ferric ion complex salt, followed by a blixing bath containing an aminopolycarboxylic acid ferric ion complex salt and a fixing agent. In other words, the inventors have found that by using the bleaching bath containing the aminopolycarboxylic acid ferric ion complex salt, which is weak in the bleaching power, followed by the blixing bath containing the aminopolycarboxylic acid ferric ion complex salt and the fixing agent, it is possible to ensure de-silvering of the photographic element in a shorter time than in prior art processes wherein bleaching and fixing baths are used, and to minimize the likelihood of the formation of the leuco form of cyan dye, which has been one of the problems in the use of the blixing bath. These are unexpected advantages since the said blixing bath is weak in bleaching power and would ordinarily be considered incapable of easily processing a color photographic element particularly one of high sensitivity and high silver content.

As mentioned above, the bleaching power of the aminopolycarboxylic acid ferric ion complex salt is not always sufficient and becomes weaker in the blixing bath in which the complex salt and the fixing agent coexist. Therefore, desilvering of a color photographic element of high-speed and high silver content has always been done by keeping the color photographic element in a bleaching bath for a long time, and thereafter subjecting it to a separate fixing bath. In this method, a water washing step is usually required between the bleaching and the fixing steps in order to avoid the incorporation of the bleaching solution into the fixing bath to thereby interfere with the formation of the leuco form of cyan dye. Alternatively elevation of the pH value of the fixing bath is required to avoid the formation of leuco form of cyan dye, as disclosed in Japanese Patent Public Disclosure No. 70533/1982.

U.S. Pat. No. 3,189,452 discloses de-silvering in a blixing solution and it also describes that a bleach bath containing a ferricyanide having a strong bleaching power is required after the blixing so that the leuco form of the cyan dye is converted to the colored form of the cyan dye.

From the common knowledge set out above it is not possible to imagine or anticipate the advantages of the process of this invention which comprises processing the photographic element in the bleaching bath for a shortened time, followed by the blixing bath, in view of the de-silvering ability and the formation of the leuco form of cyan dye.

Further the inventors have found that the color photographic element containing the cyan dye-forming coupler of the following formula (I) or (II) produces good quality color reproductions when it is processed by the process of this invention wherein the time for de-silvering is shortened as much as possible. Formulas (I) and (II) are as follows:

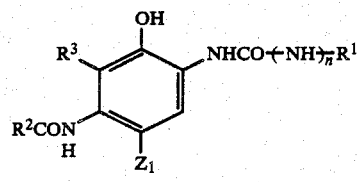

(I)

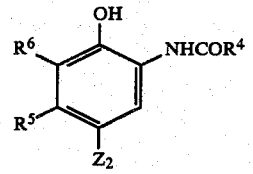

(II)

wherein $R^1$, $R^2$ and $R^4$ represent substituted or unsubstituted aliphatic, aryl or heterocyclic group, $R^3$ and $R^6$ represent a hydrogen atom, halogen atom, substituted or unsubstituted aliphatic, aryl or acylamino group, or non-metallic atom group which forms a nitrogen-containing five or six membered ring, $R^5$ represents a substituted or unsubstituted alkyl group (preferably having at least two carbon atoms), $Z_1$ and $Z_2$ represent a hydrogen atom or a group which can be released at the time of the coupling reaction with a color developing agent, and n represents 0 or 1.

When the cyan couplers of the above formulas are used, good quality color reproductions can be attained without softening of the gradation of the cyan image even when the bleaching is carried out for a shortened time.

DETAILED DESCRIPTION OF THE INVENTION

The aminopolycarboxylic acid ferric ion complex salts used as a bleaching agent both in the bleaching bath and in the blixing bath are a complex of ferric ion and an aminopolycarboxylic acid or salt thereof. The aminopolycarboxylic acid ferric ion complex salts used in the blixing bath may be the same as or different from those used in the bleaching bath.

Typical examples of the aminopolycarboxylic acid and salt thereof include:

A-1 ethylenediaminetetraacetic acid
A-2 disodium ethylenediaminetetraacetate
A-3 diammonium ethylenediaminetetraacetate
A-4 tetra(trimethylammonium)ethylenediaminetetraacetate
A-5 tetrapotassium ethylenediaminetetraacetate
A-6 tetrasodium ethylenediaminetetraacetate
A-7 trisodium ethylenediaminetetraacetate
A-8 diethylenetriaminepentaacetic acid
A-9 pentasodium diethylenetriaminepentaacetate
A-10 ethylenediamine-N-(β-oxyethyl)-N,N',N'-triacetic acid
A-11 trisodium ethylenediamine-N-(β-oxyethyl)-N,N',N'-triacetate
A-12 triammonium ethylenediamine-N-(β-oxyethyl)-N,N',N'-triacetate
A-13 propylenediaminetetraacetic acid
A-14 disodium propylenediaminetetraacetate
A-15 nitrilotriacetic acid
A-16 trisodium nitrilotriacetate
A-17 cyclohexanediaminetetraacetic acid
A-18 disodium cyclohexanediaminetetraacetate
A-19 iminodiacetic acid
A-20 dihydroxyethylglycine
A-21 ethyletherdiaminetetraacetic acid
A-22 glycoletherdiaminetetraacetic acid
A-23 ethylenediaminetetrapropionic acid It is to be understood that these compounds are described only for the purpose of illustration and therefore, other aminopolycarboxylic acids can also be used in this invention.

Among the above illustrated compounds, A-1, A-2, A-3, A-8, A-17, A-18 and A-19 are particularly preferred.

The aminopolycarboxylic acid ferric ion complex salts may be used in the form of a complex salt or they may be formed in a solution by mixing a ferric salt such as ferric sulfate, ferric chloride, ferric nitrate, ferric ammonium sulfate, etc. with the aminopolycarboxylic acid. The complex salt may be used alone or in combination with one or more of other complex salts. When the complex salt is formed in a solution, one or more aminopolycarboxylic acids and one or more ferric salts may be used. In all cases, aminopolycarboxylic acid may be used in excess of the amount necessary to form the ferric ion complex salt.

The bleaching solution or the blixing solution containing the ferric ion complex salt may contain other metallic ion complex salts than iron, such as cobalt, copper, etc.

The bleaching solutions used in this invention may contain, in addition to the bleaching agents and the compounds mentioned above, re-halogenating agents such as bromides, for example, potassium bromide, sodium bromide, ammonium bromide, or chlorides, for example, potassium chloride, sodium chloride, ammonium chloride. Any of the addenda used in conventional bleaching solutions may be added to the bleaching solutions used in this invention including inorganic acids, organic acids and salts thereof having the capacity for buffering a pH, for example, nitrates such as sodium nitrate, ammonium nitrate, boric acid, borax, sodium metaborate, acetic acid, sodium acetate, sodium carbonate, potassium carbonate, phosphorous acid, phosphoric acid, sodium phosphate, citric acid, sodium citrate, tartaric acid and the like.

The amount of the bleaching agents contained in one liter of the bleaching solution used in this invention is 0.1 to 1 mole, preferably 0.2 to 0.5 mole. The pH of the bleaching bath is adjusted to 4.0 to 8.0, preferably 5.0 to 6.5.

The amount of the bleaching agents contained in one liter of the blixing solution used in this invention is 0.05 to 0.5 mole, preferably 0.1 to 0.3 mole.

The inventors further have found that the effect of the addition of at least one bleach accelerator selected from the compounds having mercapto groups or disulfide linkage, isothiourea derivatives and thiazolidine derivatives to the bleaching bath used in this invention is superior to the effect of the addition of the same accelerator to the bleaching bath used in the prior art bleaching and fixing steps. In addition, they have also found that the bleach accelerating effect is achieved and maintained for much longer than is the effect obtained in the prior art de-silvering process comprising the bleaching bath and the fixing bath.

The fixing agents which may be used in the blixing bath used in this invention include thiosulfates such as sodium thiosulfate, ammonium thiosulfate, sodium ammonium thiosulfate and potassium thiosulfate, thiocyanates such as sodium thiocyanate, ammonium thiocyanate and potassium thiocyanate, thiourea, thioether, etc. The amount of the fixing agents contained in one liter of the blixing solution is 0.3 to 3 moles, preferably 0.5 to 2 moles.

In addition to the bleaching agents and the fixing agents described above, any of the addenda may be added to the blixing solution used in this invention, if required.

For example, one or more pH adjusting agents may be added such as sulfites, e.g. sodium sulfite, ammonium sulfite, etc., boric acid, borax, sodium hydroxide, potassium hydroxide, sodium carbonate, potassium carbonate, sodium hydrogen carbonate, acetic acid, and sodium acetate. Various antifoaming agents, surface-active agents, alkali metal halides such as potassium iodide, potassium bromide, ammonium bromide, etc., ammonium halides, hydroxylamine, hydrazine or addition products of aldehyde with bisulfite may also be contained in the blixing solution used in this invention.

The pH of the blixing solution used in this invention is adjusted to 5 to 8, preferably 6 to 7.5.

Preferably, the time for bleaching in this invention is 20 seconds to 4 minutes. The time is more preferably 20 seconds to 2 minutes, where a color photographic element containing the cyan dye-forming couplers of the formula (I) or (II) is processed and the bleach accelerating agent of the formulas (III) to (IX) described after is used, while it is preferably 1 to 4 minutes where the accelerating agent is not used. The bleaching time is preferably 40 seconds to 2 minutes where a color photographic element not containing the cyan dye-forming couplers of the formula (I) or (II) is processed and the bleach accelerating agent of the formulas (III) to (IX) is used, while it is preferably 1.5 to 4 minutes where the accelerating agent is not used.

The time for blixing is preferably 1 to 5 minutes, more preferably 1.5 to 3.5 minutes. Less than 20 seconds of bleaching time results in poor de-silvering even if the blixing time is extended, while less than one minute of blixing time also results in poor de-silvering even if the bleaching time is extended.

In this invention, a water washing step may be provided between the bleaching and the blixing steps. The advantages of this invention are not impaired even when a water wash step in which very small amount of water is supplied is used.

Preferably, a replenisher is introduced into the blixing bath in this invention. The replenisher contains essential components such as the bleaching agent or the fixing agent. A replenisher containing the fixing agent is advantageously used.

When the processing is in progress, the overflow solution, which flows out of the bleaching bath when the bleaching replenisher is added thereto, may be introduced into the blixing bath. This is very economical because the level of the bleaching agent in the blixing bath is maintained by the introduction of the overflow solution from the preceding bleaching bath. From the stand point of the prevention of environmental pollution, it is desirable to decrease the amount of the waste liquid of the photographic process, which has high biochemical oxygen demand (BOD) and high chemical oxygen demand (COD). The decrease in the amount of the waste liquid by the use of the overflow solution also makes the photographic process more economical.

In the process wherein the replenisher is introduced into the blixing bath, the overflow solution from the bleaching bath, which is discharged in the prior art process, is introduced into the blixing bath. As a result, the overflow solution functions as a solvent which dilutes the replenisher component to the desired level. Accordingly, the replenisher may be supplied to the blixing bath in the form of a concentrated liquid, which results in a decrease in the amount of waste liquid.

As described earlier, the incorporation of the bleaching solution into the fixing bath brings about the formation of the leuco form of cyan dye and significantly damages photographic properties and therefore, it is usual to provide a water washing step between the bleaching step and the fixing step so that the incorporation is prevented. NEOCOLOR CHEMISTRY FOR C-41 NEGATIVES, First Wash (published by L. B. RUSSELL CHEMICALS, U.S.A.) describes that insufficient water washing brings about the problems just mentioned above and therefore a water wash is very important.

Japanese Patent Public Disclosure No. 70533/1982 discloses that it is necessary to raise the pH of the bleaching bath when the water washing step is omitted so that the formation of the leuco form of cyan dye and the degradation of the bleaching solution are prevented. Thus, the incorporation of the bleaching solution into the fixing solution has been considered very disadvantageous. It is therefore apparent that this invention in which the overflow solution from the bleaching bath is mixed with the fixing agent to form the blixing solution is quite different from or contrary to the prior art concept.

In this invention, the amount of the bleaching bath overflow solution introduced to the blixing bath and the amount of the bleaching agent—containing solution supplied to the blixing bath are adjusted so that the concentrations of the bleaching agent and the fixing agent in the blixing bath are maintained within the range described earlier. The amounts depend on the concentration of the bleaching agent in the overflow solution to be introduced and the concentration of the fixing agent to be supplied and they are preferably 150 ml to 900 ml per one square meter of the photographic element to be processed.

In this invention, the replenisher supplied to the blixing bath may contain any of the addenda which can be added to the fixing bath, for example, conventional fixing agents such as ammonium thiosulfate, sodium thiosulfate, etc., sulfites, bisulfites, buffers and chelating agents. The concentration of each of these components in the replenisher may be adjusted so as to form a blixing solution of the desired concentration when the replenisher is mixed with the overflow solution from the bleaching bath and it may be higher than the concentration in the replenisher to be supplied to the conventional fixing bath. As a result, it is possible to decrease the amount of waste liquid and consequently, to lower the cost for the treatment of the waste liquid.

The concentration of the fixing agent contained in the replenisher supplied to the blixing bath is preferably 0.5 to 4 mole/l, more preferably 1 to 3 mole/l.

The pH of the replenisher is preferably 6 to 10, more preferably 7 to 9. The replenisher may contain the aminopolycarboxylic acid ferric ion complex salts, ammonium halides or alkali metal halides such as ammonium bromide, sodium bromide, sodium iodide and the like.

In this invention, the overflow solution from the bleaching bath may be introduced into the blixing bath directly, for example, by connecting the overflow tube on the bleaching bath to the blixing bath, or indirectly, for example, by storing the overflow solution in a container, mixing it with a fixing agent-containing solution and then introducing the mixed solution into the blixing bath or introducing the stored overflow solution and the fixing agent into the blixing bath separately.

The cyan dye-forming couplers of the formula (I) or (II) used in this invention will now be explained in detail.

In the formulas, $R^1$, $R^2$ and $R^4$ represent aliphatic groups having 1 to 32 carbon atoms such as methyl, butyl, tridecyl, cyclohexyl and allyl; aryl group such as phenyl and naphthyl; or heterocyclic group such as 2-pyridyl, 2-imidazolyl, 2-furyl and 6-quinolyl; and the aliphatic, the aryl and the heterocyclic groups may be substituted by one or more groups selected from alkyl, aryl, heterocyclic, alkoxy such as methoxy and 2-methoxyethoxy, aryloxy such as 2,4-ditert-amylphenoxy, 2-chlorophenoxy and 4-cyanophenoxy, alkenyloxy such as 2-propenyloxy, acyl such as acetyl and benzoyl, ester such as butoxycarbonyl, phenoxycarbonyl, acetoxy, benzoyloxy, butoxysulfonyl and toluensulfonyl, amido such as acetylamino, ethylcarbamoyl, dimethylcarbamoyl, methanesulfonamido and butylsulfamoyl, sulfamido such as dipropylsulfamoylamino, imido such as succinimido and hydantoinyl, ureido such as phenylureido and dimethylureido, aliphatic or aromatic sulfonyl such as methanesulfonyl and phenylsulfonyl, aliphatic or aromatic thio such as ethylthio and phenylthio, hydroxy, cyano, carboxy, nitro, sulfo, halogen atoms and the like.

In the formula (I), $R^3$ represents a hydrogen atom, halogen atom, aliphatic group, aryl group, acylamino group or a group of non-metallic atoms which form a nitrogen-containing five or six membered ring together with $R^2$. These groups may be substituted by one or more substituting groups as defined previously with respect to $R^1$.

In the formula (I), n represents 0 or 1.

In the formula (II), $R^5$ represents a substituted or unsubstituted alkyl having at least two carbon atoms such as ethyl, propyl, butyl, pentadecyl, tert-butyl, cyclohexyl, cyclohexylmethyl, phenylthiomethyl, dodecyloxyphenylthiomethyl, butaneamidomethyl and methoxymethyl.

In the formula (I), $R^6$ represents a hydrogen atom, halogen atom, aliphatic group, aryl group, or acylamino group.

In the formulas (I) and (II), $Z_1$ and $Z_2$ each represent a hydrogen atom or a coupling off group, for example, halogen atom such as fluorine, chlorine and bromine atoms, alkoxy such as ethoxy, dodecyloxy, methoxyethylcarbamolymethoxy, carboxypropyloxy and methylsulfonylethoxy, aryloxy such as 4-chlorophenoxy, 4-methoxyphenoxy and 4-carboxyphenoxy, acyloxy such as acetoxy, tetradecanoyloxy and benzoyloxy, sulfonyloxy such as methanesulfonyloxy and toluenesulfonyloxy, amido such as dichloroacetylamino, heptafluorobutyrylamino, methanesulfonylamino and toluenesulfonylamino, alkoxycarbonyloxy such as ethoxycarbonyloxy and benzyloxycarbonyloxy, aryloxycarbonyloxy such as phenoxycarbonyloxy, aliphatic or aromatic thio such as ethylthio, phenylthio and tetrazolylthio, imido such as succinimido and hydantoinyl, and aromatic azo such as phenylazo. These coupling off groups may contain a photographically useful group.

In the formula (I), $R^1$ is preferably aryl or heterocyclic group, and more preferably an aryl group substituted by a halogen atom, alkyl, alkoxy, aryloxy, acylamino, acyl, carbamoyl, sulfonamido, sulfamoyl, sulfonyl, sulfamido oxycarbonyl or cyano group.

In the formula (I), if $R^2$ and $R^3$ do not form a ring together, $R^2$ is preferably a substituted or unsubstituted alkyl or aryl, and more preferably an alkyl substituted by substituted aryloxy, and $R^3$ is preferably hydrogen atom.

In the formula (II), $R^4$ is preferably a substituted or unsubstituted alkyl or aryl, and more preferably an alkyl substituted by substituted aryloxy.

In the formula (II), $R^5$ is preferably an alkyl having 2 to 15 carbon atoms or methyl having a substituting group which has at least one carbon atom, which substituting group is preferably arylthio, alkylthio, acylamino, aryloxy or alkyloxy.

In the formula (II), $R^5$ is preferably an alkyl having 2 to 15 carbon atoms and more preferably an alkyl having 2 to 4 carbon atoms.

In the formula (II), $R^6$ is preferably a hydrogen or halogen and more preferably a chlorine atom or fluorine atom.

In the formulas (I) and (II), $Z_1$ and $Z_2$ are each a hydrogen atom, halogen atom, alkoxy, aryloxy, acyloxy or sulfonamido group.

In the formula (II), $Z_2$ is preferably a halogen and more preferably a chlorine or fluorine atom.

In the formula (I), if n is zero, $Z_2$ is preferably a halogen and more preferably a chlorine or fluorine atom.

The cyan dye-forming couplers of the formulas (I) or (II) are usually incorporated in silver halide emulsion layers, particularly a red sensitive emulsion layer. The amount of the coupler incorporated is $2\times10^{-3}$ to $5\times10^{-1}$ mole/mole Ag, and preferably $1\times10^{-2}$ to $5\times10^{-1}$ mole/mole Ag.

The cyan dye-forming couplers of the formulas (I) and (II) may easily be prepared according to the methods, as described in U.S. Pat. Nos. 3,772,002; 4,334,001; 4,327,173; and 4,427,767.

Typical illustrative examples of the cyan dye-forming couplers of the formulas (I) and (II) include the following to which this invention is not restricted:

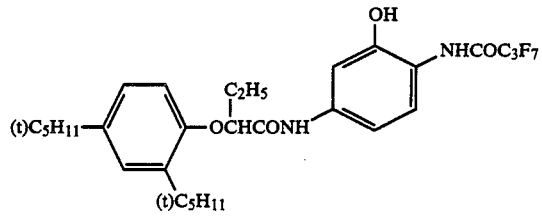

(C-1)

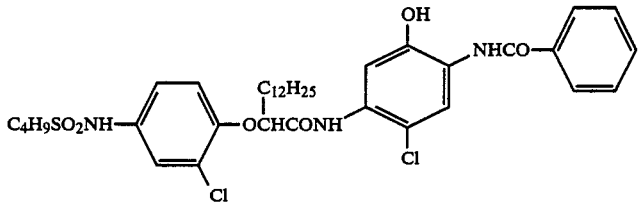

(C-2)

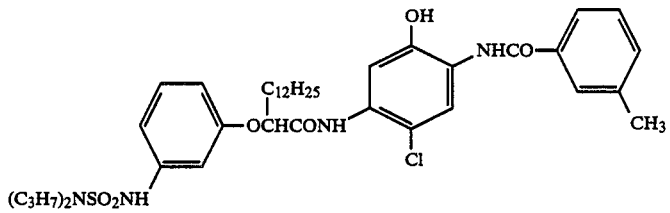

(C-3)

-continued
(C-4)
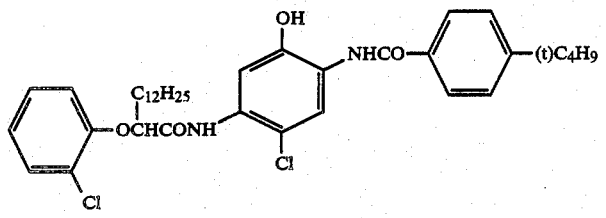
(C-5)
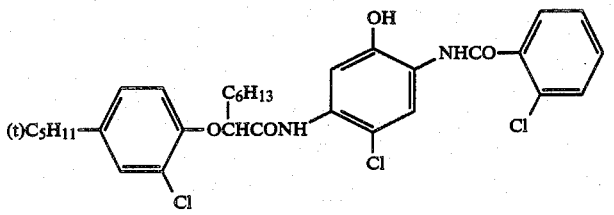
(C-6)
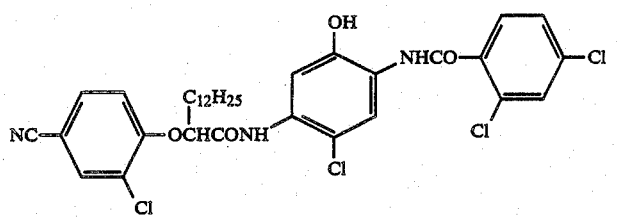
(C-7)
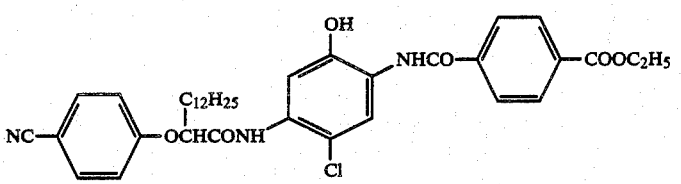
(C-8)
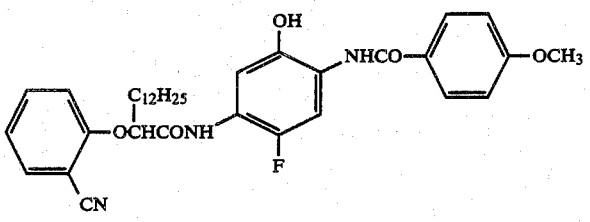
(C-9)
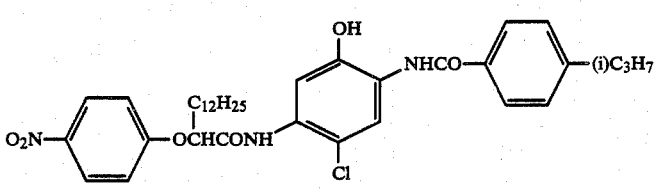
(C-10)
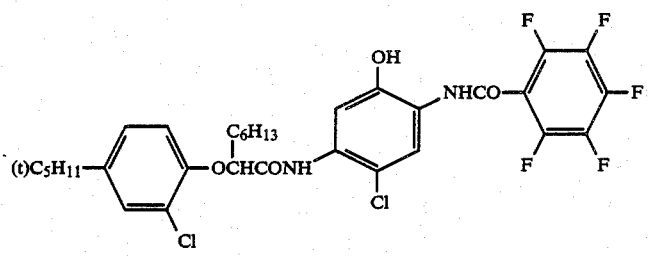

-continued
(C-11)
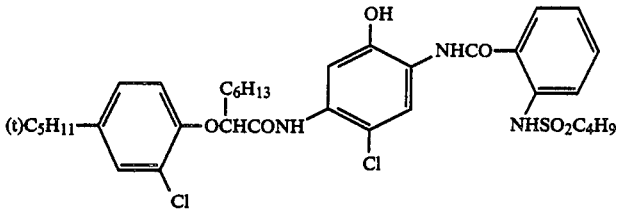
(C-12)
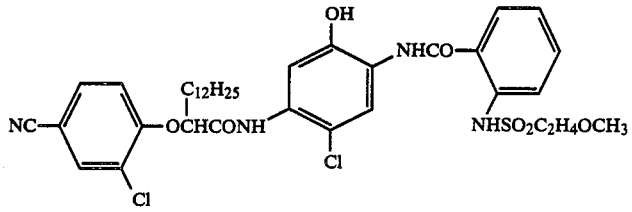
(C-13)
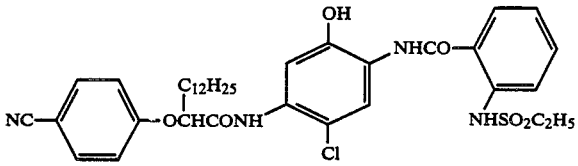
(C-14)
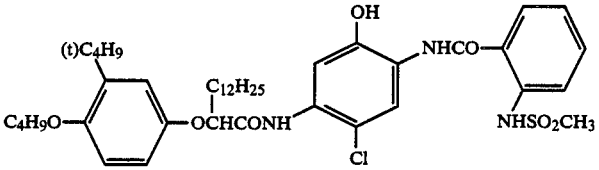
(C-15)
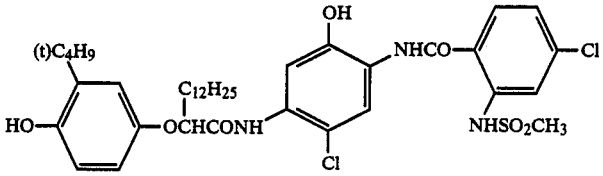
(C-16)
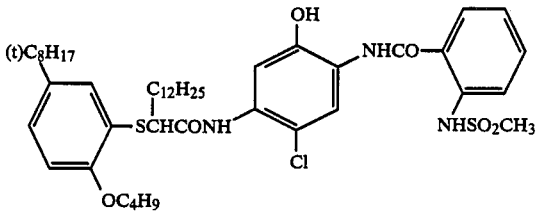
(C-17)
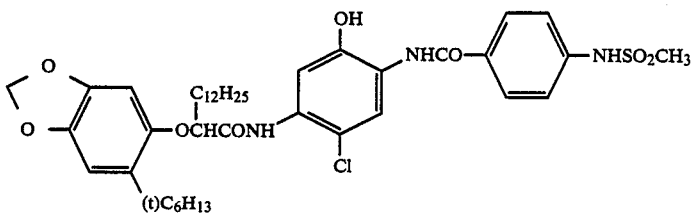

-continued
(C-18)
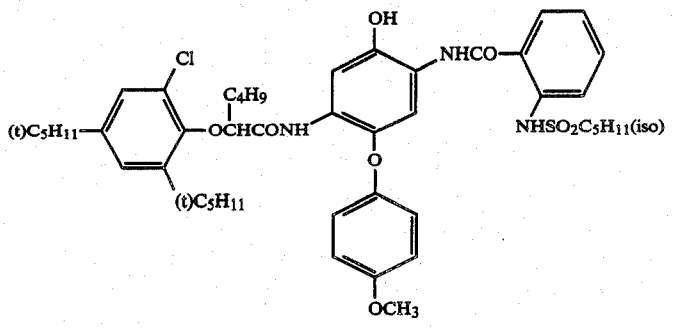
(C-19)
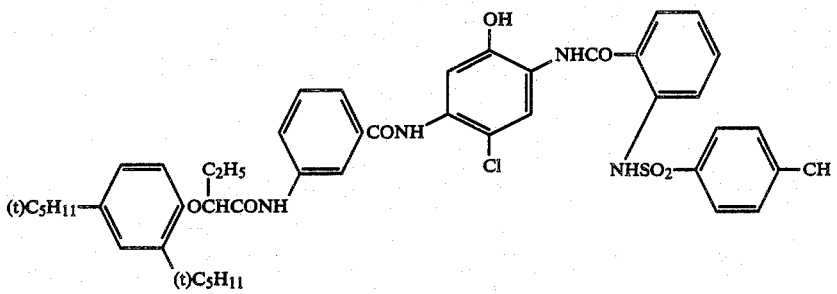
(C-20)
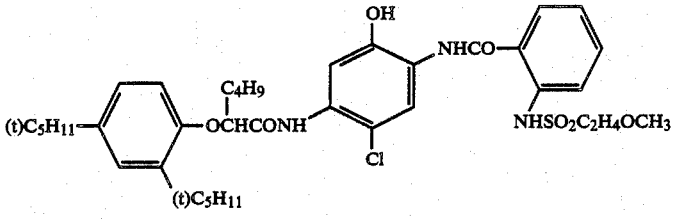
(C-21)
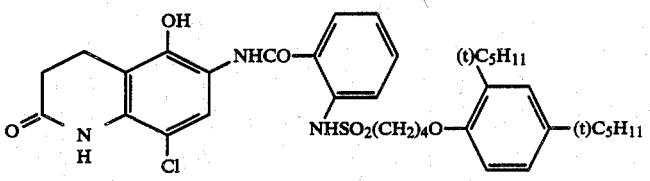
(C-22)
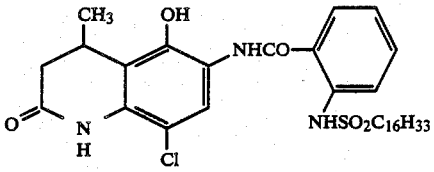
(C-23)
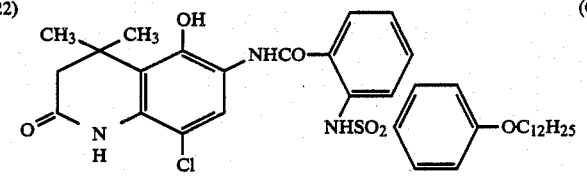
(C-24)
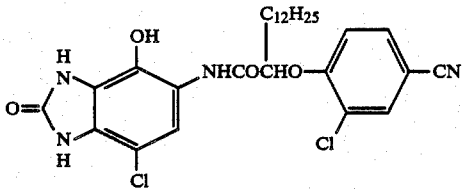
(C-25)
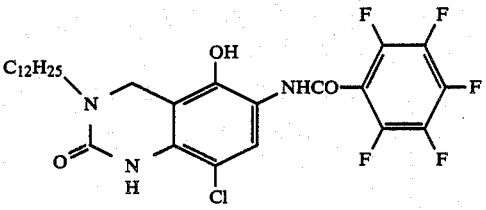
(C-26)
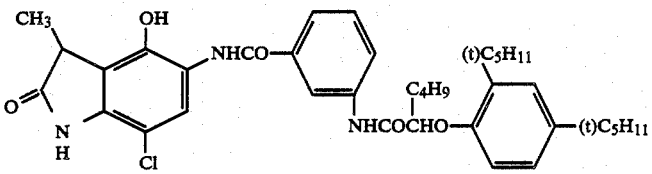

-continued
(C-27)
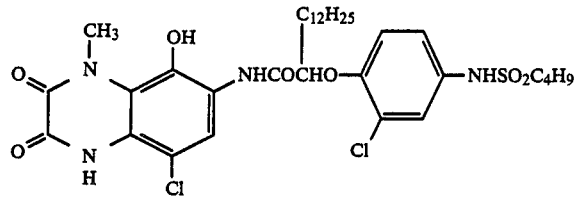
(C-28)
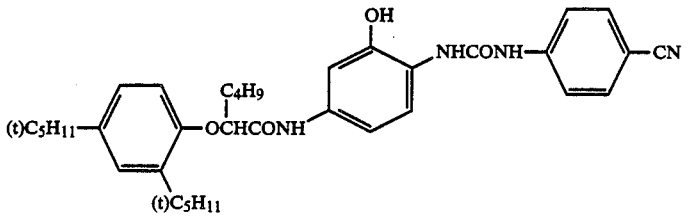
(C-29)
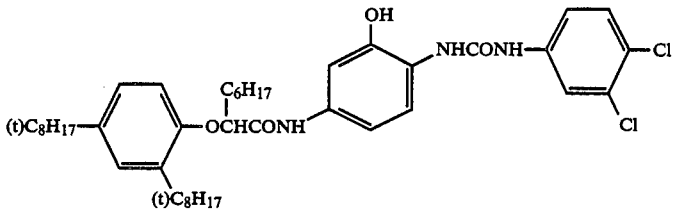
(C-30)
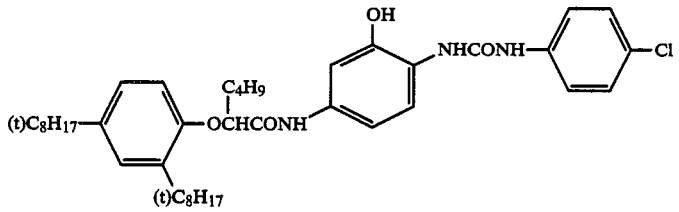
(C-31)
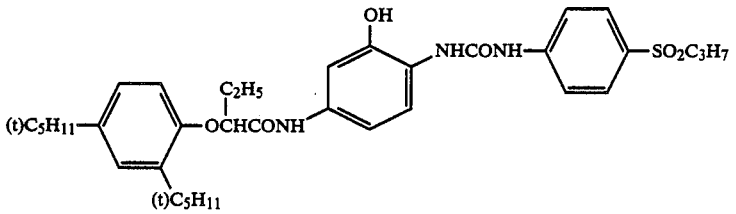
(C-32)
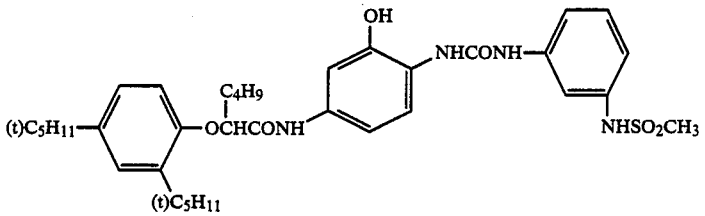
(C-33)
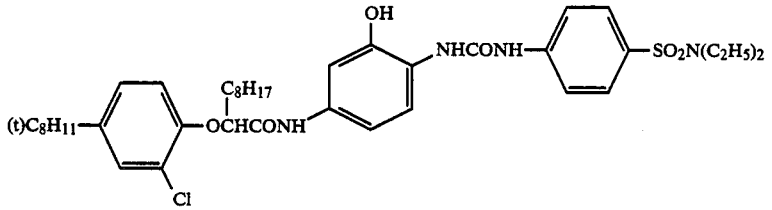

-continued
(C-34)
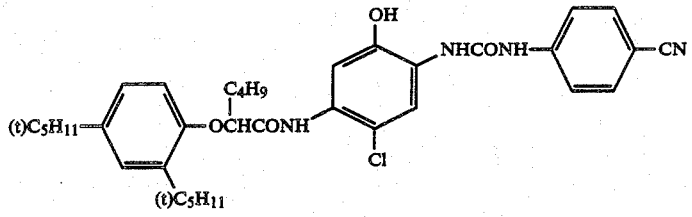
(C-35)
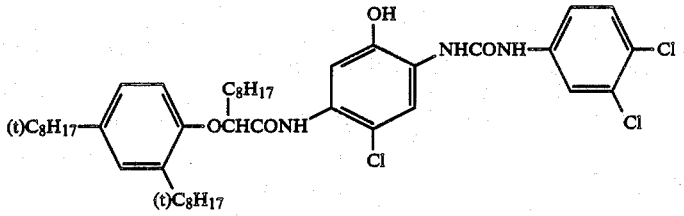
(C-36)
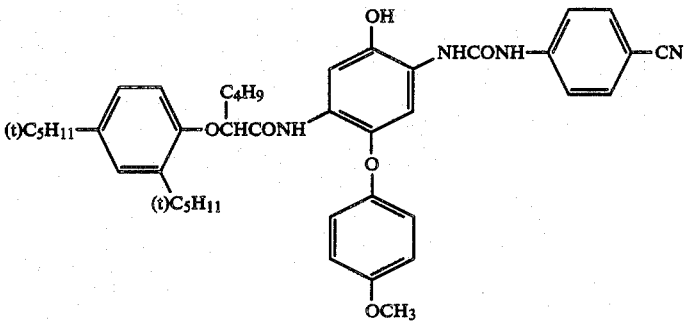
(C-37)
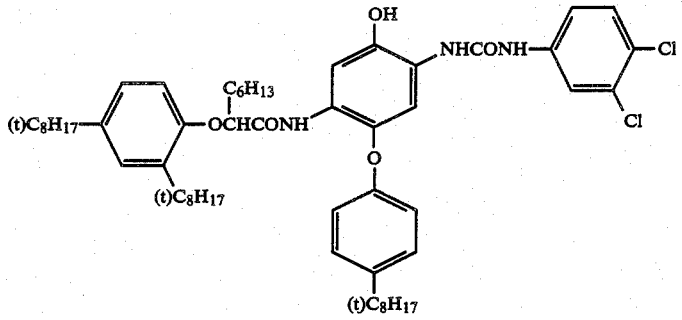
(C-38)
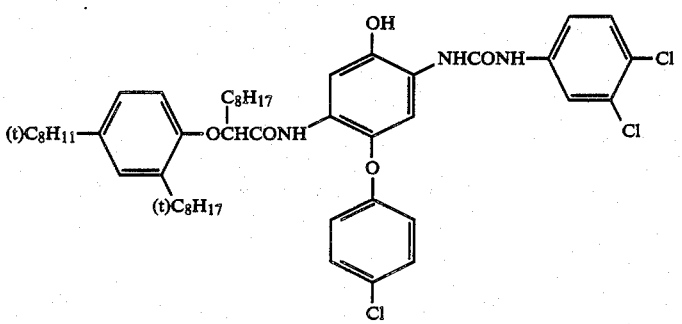

-continued
(C-39)
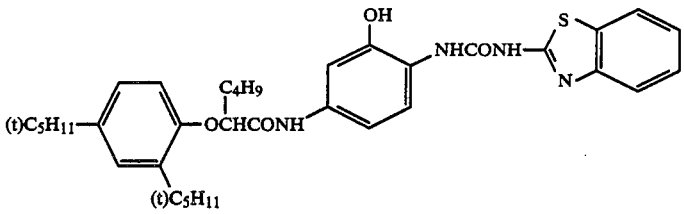
(C-40)
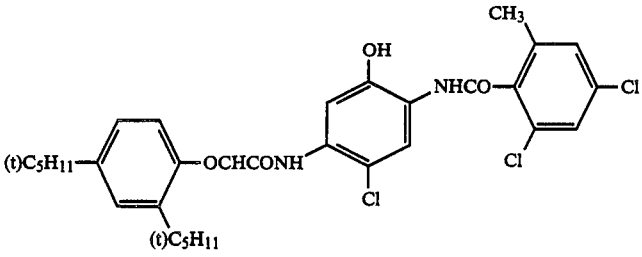
(C-41)
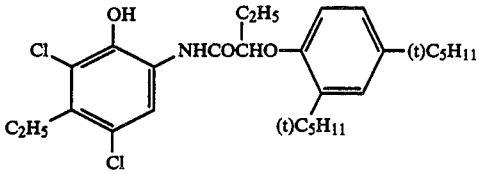
(C-42)
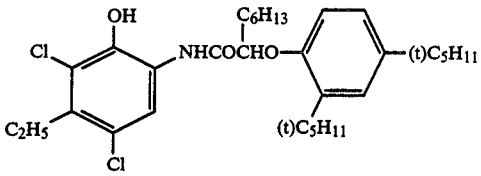
(C-43)
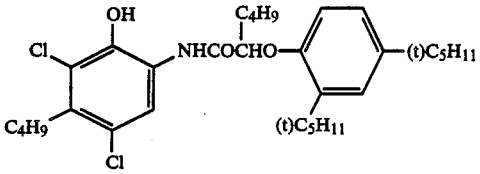
(C-44)
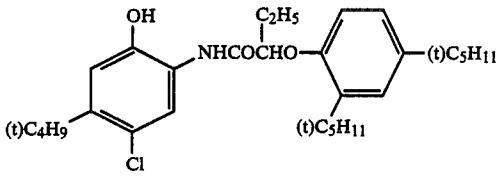
(C-45)
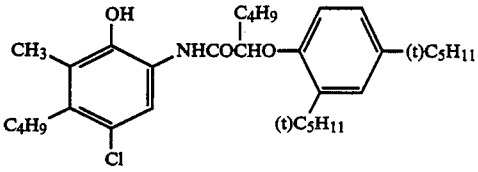
(C-46)
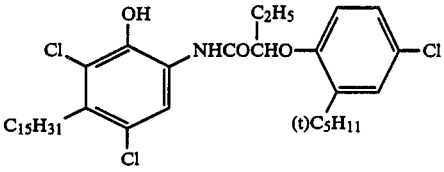
(C-47)
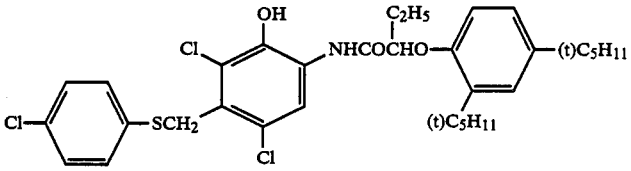
(C-48)
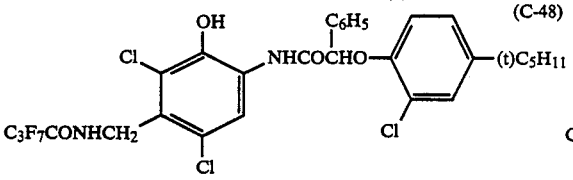
(C-49)
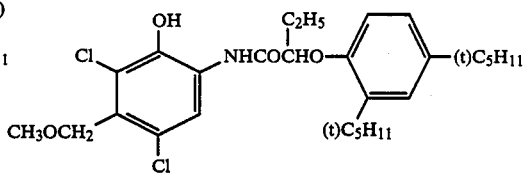
(C-50)
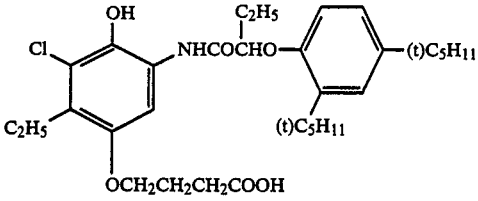

The bleaching accelerators will now be explained in detail.

The bleaching accelerators which may be incorporated in the bleaching bath used in this invention are any compounds which have a bleach accelerating effect and are selected from compounds having mercapto groups or disulfide linkages, thiazolidine derivatives or isothiourea derivatives. The accelerators are preferably selected from the compounds of the formulas (III) to (IX).

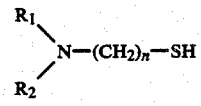

(III)

wherein $R_1$ and $R_2$ may be the same or different and represent hydrogen atom, substituted or unsubstituted lower alkyl preferably having 1 to 5 carbon atoms, particularly methyl, ethyl and propyl; or acyl preferably having 1 to 3 carbon atoms, such as acetyl and propionyl, and n is 1, 2 or 3.

$R_1$ and $R_2$ may form a ring together.

$R_1$ and $R_2$ are preferably a substituted or unsubstituted lower alkyl.

Examples of the substituting groups which $R_1$ and $R_2$ may contain include hydroxyl, carboxyl, sulfo and amino groups.

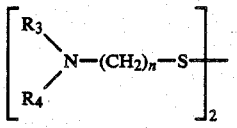

(IV)

wherein $R_3$ and $R_4$ are the same as described previously regarding $R_1$ and $R_2$ of the formula (I), and n is 1, 2 or 3.

$R_3$ and $R_4$ may form a ring together.

$R_3$ and $R_4$ are preferably a substituted or unsubstituted lower alkyl group.

Examples of the substituting groups which $R_3$ and $R_4$ contain include hydroxyl, carboxyl, sulfo and amino groups.

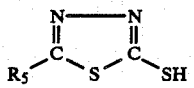

(V)

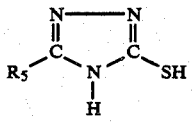

(VI)

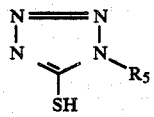

(VII)

wherein $R_5$ represents a hydrogen atom, halogen atom such as chlorine or bromine, amino a, substituted or unsubstituted lower alkyl preferably having 1 to 5 carbon atoms, particularly methyl, ethyl and propyl, and alkyl-containing amino such as methylamino, ethylamino, dimethylamino and diethylamino groups.

Examples of the substituting groups which $R_5$ contains include hydroxyl, carboxyl, sulfo and amino groups.

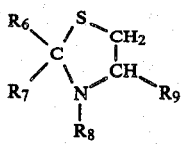

(VIII)

wherein $R_6$ and $R_7$ may be the same or different and each represents a hydrogen atom, a substituted or unsubstituted alkyl, preferably a lower alkyl such as methyl, ethyl and propyl a, substituted or unsubstituted phenyl or a substituted or unsubstituted heterocyclic, more specifically a heterocyclic having one or more hetero atoms such as nitrogen, oxygen and sulfur atoms, for example pyridine ring, thiophene ring, thiazolidine ring, benzoxazole ring, benzotriazole ring, thiazole ring and imidazole ring.

$R_8$ represents a hydrogen atom or a substituted or unsubstituted lower alkyl preferably having 1 to 3 carbon atoms, such as methyl and ethyl.

Examples of the substituents which $R_6$, $R_7$ or $R_8$ may contain include hydroxyl, carboxyl, sulfo, amino and lower alkyl groups, $R_9$ represents a hydrogen atom or a carboxyl group.

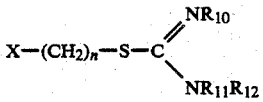

(IX)

wherein $R_{10}$, $R_{11}$ and $R_{12}$ may be the same or different and each represents a hydrogen atom or lower alkyl preferably having 1 to 3 carbon atoms, such as methyl and ethyl.

$R_{10}$ and $R_{11}$ or $R_{12}$ may form a ring together.

X represents an amino, sulfonic or carboxyl group which may contain one or more substituents, for example, a lower alkyl such as methyl and acetoxyalkyl such as acetoxymethyl.

$R_{10}$, $R_{11}$ and $R_{12}$ are most preferably a hydrogen atom, methyl group or ethyl group, and X is most preferably amino or dialkylamino group.

Typical illustrative examples of the compounds represented by the formulas (III) to (IX) include the following:

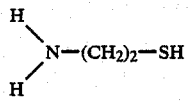

(III)-(1)

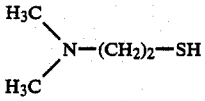

(III)-(2)

-continued
(III)-(3)
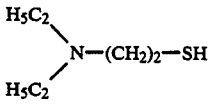
(III)-(4)
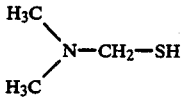
(III)-(5)
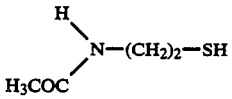
(III)-(6)
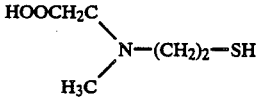
(III)-(7)
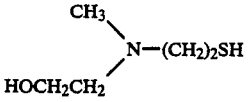
(III)-(8)
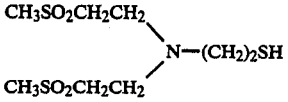
(III)-(9)
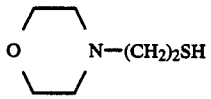
(IV)-(1)
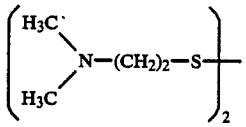
(IV)-(2)
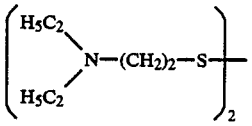
(IV)-(3)
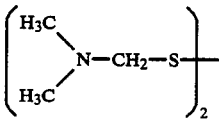
(IV)-(4)
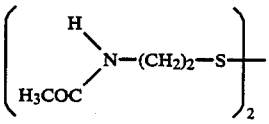
(IV)-(5)
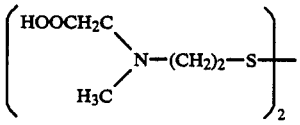
-continued
(IV)-(6)
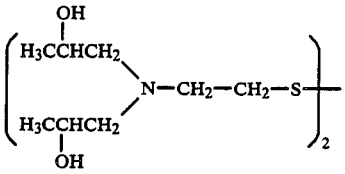
(IV)-(7)
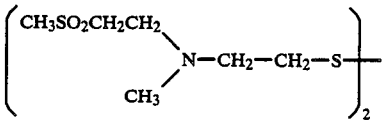
(IV)-(8)
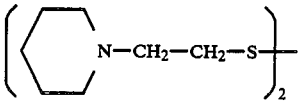
(IV)-(9)
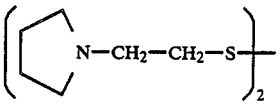
(IV)-(10)
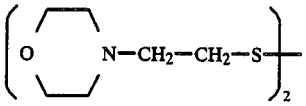
(V)-(1)
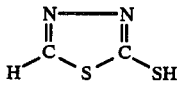
(V)-(2)
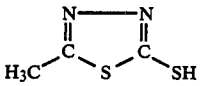
(V)-(3)
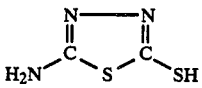
(V)-(4)
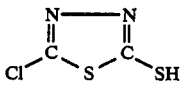
(VI)-(1)
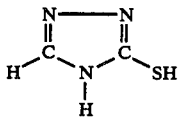
(VI)-(2)
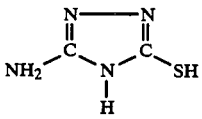
(VI)-(3)
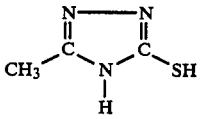
(VII)-(1)
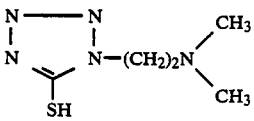

-continued (VII)-(2)

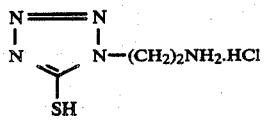

(VIII)-(1)

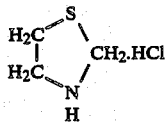

(VIII)-(2)

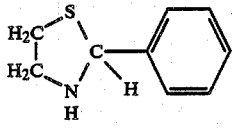

(VIII)-(3)

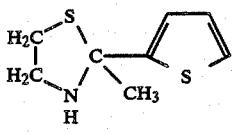

(VIII)-(4)

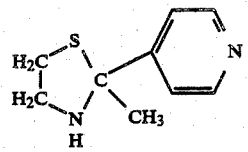

(VIII)-(5)

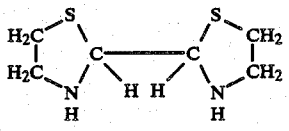

(VIII)-(6)

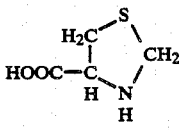

(IX)-(1)

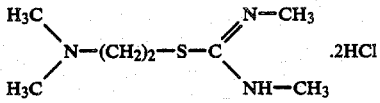

(IX)-(2)

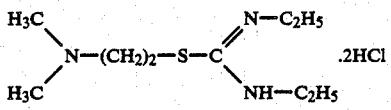

(IX)-(3)

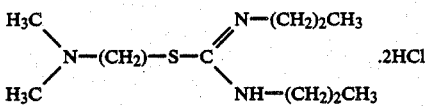

(IX)-(4)

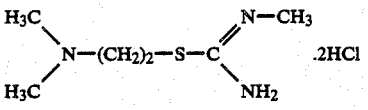

(IX)-(5)

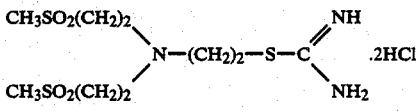

-continued (IX)-(6)

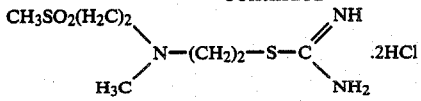

(IX)-(7)

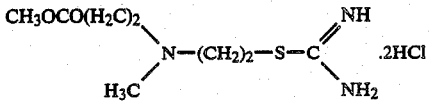

(IX)-(8)

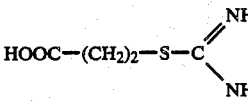

(IX)-(9)

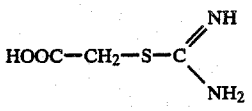

(IX)-(10)

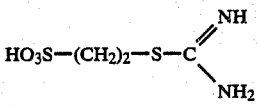

(IX)-(11)

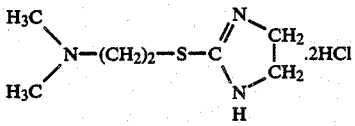

All the compounds of the formulas (III) to (IX) may be prepared by well known methods. For example, the method for the preparation of the compounds of the formula (III) is described in U.S. Pat. No. 4,285,98, G. Schwarzenbach et al., Helv. Chim. Acta., 38, 1147 (19555), and R. O. Clinton et al., J.Am. Chem. SOC., 70, 950 (1948); that of the formula (IV) is described in Japanese Patent Public disclosure No. 95630/1978; that of the formulas (V) and (VI) is described in Japanese Patent Public Disclosure No. 52534/1979; that of the formula (VII) is described in Japanese Patent Public Disclosure Nos. 68568/1976, 70763/1976 and 50169/1978; that of the formula (VIII) is described in Japanese Patent Publication No. 9854/1978 and Japanese Patent Public Disclosure No. 214855/1984 and (U.S. Pat. No. 4,508,817); and that of the formula (IX) is described in Japanese Patent Public Disclosure No. 94927/1978.

The amount of the compounds having mercapto groups or disulfide linkages, thiazoline derivatives or isothiourea derivatives contained in the bleaching solution used in this invention depends on the kind of photographic elements to be processed, temperature at which the elements are processed, time required for the desired processing and other conditions. The amount is suitably $1\times10^{-5}$ to $10^{-1}$ mole/l, and preferably $1\times10^{-4}$ to $5\times10^{-2}$ mole/l.

These compounds are usually dissolved in a solvent such as water, alkali, organic acids, organic solvents and the like before they are added to the bleaching solution. Alternatively, they may be added directly, that is, in the form of power, to the bleaching solution, which does not have any influence on the bleach accelerating effect.

Any of the silver halides such as silver bromide, silver bromoiodide, silver bromochloroiodide, silver chlorobromide, silver chloride can be used in the photographic emulsion layers of the color photographic elements used in this invention, especially, color photographic elements using the silver halide emulsions which contain silver iodide in the amount of preferably up to 15 mole %, particularly 2 to 12 mole %.

The emulsions used in the photographic elements processed by this invention can be prepared by well known methods as described in P. Glafkides, Chimie et Physique Photographique (Paul Montel, 1967), G. F. Duffin, Photographic Emulsion Chemistry (The Focal Press, 1966), V. L. Zelikman et al, or Making and Coating Photographic Emulsion (The Focal Press, 1964).

Cadmium salts, zinc salts, lead salts, thallium salts, iridium salts or complex salts thereof, rhodium salts or complex salts thereof, iron salts or complex salts thereof, or the like may be allowed to coexist during the formation or physical ripening of silver halide grains.

Usually, the silver halide emulsions are chemically sensitized, although they can be used without chemical sensitization, that is, in the form of the so-called primitive emulsion. The chemical sensitization can be effected by the methods as described in the book written by Glafkides or Zelikman et al, or H. Frieser Die Grundlagen der Photographischen Prozesse mit Silberhalogeniden (Akademische Verlagsgesellschaft, 1968). Namely, sulfur sensitization using a sulfur-containing compound which can react with silver ion or active gelatin, reduction sensitization using a reducing compound, noble metal sensitization using noble metals such as gold can be used alone or in combination. Examples of the sulfur sensitizers include thiosulfates, thioureas, thiazoles, rhodanines and the like. Examples of the reduction sensitizers include stannous salts, amines, hydrazine derivatives, formamidinesulfinic acid silane compounds and the like. Examples of noble metal sensitizers include complex salts of noble metals of Group VIII of the periodic table, such as gold, platinum, iridium and palladium.

The photographic emulsions may be spectrally sensitized with methine dyes or the like. Examples of useful dyes for this purpose include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes, and complex merocyanine dyes.

In addition to the light-sensitive silver halide emulsion layers described above, emulsion layers of substantially non light-sensitive silver halide fine grains may be provided so as to improve graininess or sharpness or to achieve other objects. Such substantially non light-sensitive emulsion layers can be provided over a light-sensitive silver halide emulsion layer or between the light-sensitive silver halide emulsion layer and a colloidal silver layer (yellow filter layer or halation preventing layer).

The photographic elements used in this invention may contain polyalkyleneoxides or, ether, ester or amine derivatives thereof, thioether compounds, thiomorpholines, quaternary ammonium salts, urethane derivatives, urea derivatives, imidazole derivatives, 3-pyrazolidone derivatives or the like to increase sensitivity, or contrast, or to accelerate development.

As a binder for photographic emulsion layers or other layers, gelatin is advantageously used, although other hydrophilic colloids can also be used.

The photographic elements used in this invention may contain various compounds as antifoggants or stabilizers. Examples of these antifoggants or stabilizers include azoles such as benzothiazolium salts, nitroindazoles, triazoles, benzotriazoles and benzimidazoles (particularly nitro or halogen substituted); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines; the heterocyclic mercapto compounds having a hydrophilic group such as carboxyl and sulfone groups; thioketo compounds such as oxazolinethione; azaindenes such as tetraazaindenes (particularly 4-hydroxy substituted (1,3,3a,7)tetraazaindenes); benzenethiosulfonic acids; benzenesulfinic acids; and the like.

The photographic elements used in this invention may contain inorganic or organic hardeners in the photographic emulsion layers and/or other layers. Examples of these hardeners include chromium compounds such as chromium alum and chromium acetate, aldehydes such as formaldehyde, glyoxal and glutaraldehyde, N-methylol compounds such as dimethylol urea and methyloldimethyl-hydantoin, dioxane derivatives such as 2,3-dihydroxydioxane, active vinyl compounds such as 1,3,5-triacryloyl-hexahydro-S-triazine and 1,3-vinylsulfonyl-2-propanol, active halogen compounds such as 2,4-dichloro-6-hydroxy-S-triazine, mucohalogenic acids such as mucochloric acid and mucophenoxychloric acid. These hardners may be used alone or in a combination.

The photographic emulsion layers or other layers of the photographic element used in this invention may contain various surface active agents as coating auxiliary agents, anti-static agents, or agents for improving sliding property, emulsifiability, dispersibility, anti-adhesion and photographic properties, for example for the purposes of development acceleration, high contrast and sensitization.

The photographic emulsion layers of the photographic elements used in this invention may contain, in addition to the cyan couplers described above, color-forming couplers which can form color by oxidative coupling with a primary aromatic amine developing agent such as phenylenediamine derivatives and aminophenol derivatives to form a colored dye in a color development step. Examples of these couplers include known cyan couplers such as phenolic couplers and naphtholic couplers, magenta couplers such as 5-pyrazolone couplers, pyrazolobenzimidazole couplers, cyanoacetylcoumarone couplers and open-chain acylacetonitrile couplers, and yellow couplers such as acylacetamide couplers (e.g. benzoylacetanilides and pivaloylacetoanilides). The cyan dye-forming couplers of the formula (I) or (II) can be used in a combination with known phenolic or naphtholic cyan couplers and they can also be used in the polymerized form. Of these couplers, non-diffusible couplers having a hydrophobic group called a ballast group are desirable. The couplers may be of either 4-equivalent type or 2-equivalent type to silver ion. Colored couplers having color-correcting effect or couplers capable of releasing a development inhibitor upon development (the so-called DIR couplers) may also be used. In addition to DIR couplers, colorless DIR coupling compounds which form a colorless coupling reaction product and release a development inhibitor or DIR redox compounds may also be incorporated.

The photographic elements used in this invention may contain a developing agent, typical examples of which are described in Research Disclosure, Vol. 176, p.29 (1978), "Developing agents".

The photographic elements used in this invention may contain dyes in the photographic emulsion layers or other layers as a filter dye or for the purposes of the prevention of irradiation of other objects. Examples of the dyes are described in Research Disclosure, Vol. 176, pages 25 to 26, (1978), "Absorbing and filter dyes".

The photographic elements used in this invention may also contain antistatic agents, plasticizers, matting agents, lubricating agents, ultra violet light absorbers, fluorescent whitening agents, air fog preventing agents and the like, as described in Research Disclosure, Vol. 176 (1978), pages 22 to 27.

The silver halide emulsion layers and/or other layers are coated on a support. The coating methods as described in Research Disclosure, Vol. 176, pages 27 to 28, (1978) "Coating Procedures" may be used.

The process of this invention can advantageously be applied to the processing of multilayer negative color light-sensitive materials which contain incorporated color-forming couplers or color light-sensitive materials for reversal color processing and further, color X-ray light-sensitive materials, monolayer special color light-sensitive materials or color light-sensitive materials which contain incorporated black-and-white developing agents such as 3-pyrazolidones as described in U.S. Pat. Nos. 2,751,297 and 3,902,905, Japanese Patent Public Disclosure Nos. 64339/1981, 85748/1981 and 85749/1981 and incorporated precursors of color developing agents as described in U.S. Pat. Nos. 2,478,400, 3,342,597, 3,342,599, 3,719,492 and 4,214,047 and Japanese Patent Public Disclosure No. 135628/1978. The process of this invention can be effected even if these couplers are incorporated in the developing solution.

The process of this invention may advantageously be applied to color photographic elements which contain a large amount of silver, for example, at least 3 g/m$^2$, preferably 3 to 15 g/m$^2$ of silver.

Primary aromatic amine color developing agents contained in the color developing solution used in this invention include those widely used in various color photographic processes. These developing agents include aminophenol and p-phenylenediamine derivatives. These compounds are usually used in the form of salts, for example, hydrochlorides or sulfates which are more stable than the free form thereof. These compounds are usually used in a concentration of about 0.1 g to about 30 g, preferably about 1 g to about 15 g per one liter of the color developing solution.

Examples of aminophenol developing agents include o-aminophenol, p-aminophenol, 5-amino-2-oxy-toluene, 2-amino-3-oxy-toluene and 2-oxy-3-amino-1,4-dimethyl-benzene.

Especially useful primary aromatic amine color developing agents are N-dialkyl-p-phenylenediamine compounds, alkyl and phenyl groups of which may or may not be substituted. Useful examples of these compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, and 4-amino-N-(2-methoxyethyl)-N-ethyl-3-methylaniline-p-toluenesulfonate.

In addition to the primary aromatic amine color developing agents described above, the alkaline color developing solution may optionally contain various components usually added to conventional color developing solutions, for example, alkalis such as sodium hydroxide, sodium carbonate and potassium carbonate, alkali metal sulfites, alkali metal bisulfites, alkali metal thiocyanates, alkali metal halides, benzylalcohol, water softeners and thickening agents. The pH of the color developing solution is usually at least 7, most typically about 9 to about 13.

The process of this invention may be applied to color reversal processing. Black-and-white developing solutions used in the color reversal processing include those called black-and-white first developing solutions used in reversal processing of color photographic elements and those used in processing of black-and-white light-sensitive materials. The black-and-white developing solutions used in this invention may contain various well known additives which are usually added to conventional black-and-white developing solutions.

Examples of typical additives include developing agents such as 1-phenyl-3-pyrazolidone, Metol (Registered trademark) and hydroquinone, preservatives such as sulfites, alkali accelerators such as sodium hydroxide, sodium carbonate and potassium carbonate, inorganic or organic inhibitors such as 2-methylbenzimidazole and methylbenzthiazole, water softners such as polyphosphates, and development inhibitors such as a small amount of iodides or mercapto compounds.

The process of this invention comprises the color development, the bleaching and the blixing steps described earlier. After the blixing, water washing and stabilization steps are usually provided. However, a simpler process in which after the blixing, the stabilization is carried out without substantial water washing can also be used in the process of this invention.

Washing water used in the water washing step may contain known additives, if necessary. Examples of the additives include chelating agents such as inorganic phosphoric acid, aminopolycarboxylic acid and organic phosphoric acid, germicides for the inhibition of the propagation of bacteria or Algae, hardening agents such as magnesium salts and aluminum salts, and surface active agents for the prevention of unevenness. The compounds as described in L. E. West, "Water Quality Criteria "Phot. Sci. and Eng., vol. 9 No. 6, page 344–359 (1965) can also be incorporated. Two or more washing baths can be used, if required and a multi-stage countercurrent water wash (for example, 2 to 9 stages) can also be used to save washing water.

A solution in which a color image is stabilized is used as a stabilizer in the stabilizing step. Examples of the stabilizer include a buffer solution having a pH of 3 to 6 and an aldehyde-containing solution, e.g. formalin. The stabilizer may contain, if necessary, fluorescent whitening agents, chelating agents, germicides, hardening agents and surface active agents.

Two or more stabilizing baths can be used, if necessary and a multi-stage countercurrent water wash (e.g. 2 to 9 stages) can also be used to save the stabilizing solution and further, the water wash can be eliminated.

EXAMPLE 1

Multilayer color negative films were made on different pieces of a triacetylcellulose film support. The composition of each of the layers was as follows:

---

1st layer: Antihalation layer

Gelatin layer which contains black colloidal

-continued silver.

2nd layer: Interlayer

Gelatin layer which contains an emulsified dispersion of 2,5-di-t-octylhydroquinone.

3rd layer: Low speed red-sensitive emulsion layer

| | |
|---|---|
| Silver bromoiodide emulsion (silver iodide: 5 mole %) | the amount of silver coated 1.6 g/m$^2$ |
| Sensitizing dye I | per 1 mole of silver $6 \times 10^{-5}$ mole |
| Sensitizing dye II | per 1 mole of silver $1.5 \times 10^{-5}$ mole |
| Coupler (as described in Table 1) | per 1 mole of silver 0.04 mole |
| Coupler EX-1 | per 1 mole of silver 0.003 mole |
| Coupler EX-2 | per 1 mole of silver 0.0006 mole |

4th layer: High speed red-sensitive emulsion layer

| | |
|---|---|
| Silver bromoiodide (silver iodide: 10 mole %) | the amount of silver coated 1.4 g/m$^2$ |
| Sensitizing dye I | per 1 mole of silver $3 \times 10^{-5}$ mole |
| Sensitizing dye II | per 1 mole of silver $1.2 \times 10^{-5}$ mole |
| Coupler (as described in Table 1) | per 1 mole of silver 0.02 mole |
| Coupler EX-1 | per 1 mole of silver 0.0016 mole |

5th layer: Interlayer

The same as that of the 2nd layer

6th layer: Low speed green-sensitive emulsion layer

| | |
|---|---|
| Monodisperse silver bromoiodide emulsion (silver iodide: 4 mole %) | the amount of silver coated 1.2 g/m$^2$ |
| Sensitizing dye III | per 1 mole of silver $3 \times 10^{-5}$ mole |
| Sensitizing dye IV | per 1 mole of silver $1 \times 10^{-5}$ mole |
| Coupler EX-3 | per 1 mole of silver 0.05 mole |
| Coupler EX-4 | per 1 mole of silver 0.0015 mole |
| Coupler EX-2 | per 1 mole of silver 0.0015 mole |

7th layer: High speed green-sensitive emulsion layer

| | |
|---|---|
| Silver bromoiodide emulsion (silver iodide: 10 mole %) | the amount of silver coated 1.3 g/m$^3$ |
| Sensitizing dye III | per 1 mole of silver $2.5 \times 10^{-5}$ mole |
| Sensitizing dye IV | per 1 mole of silver $0.8 \times 10^{-5}$ mole |
| Coupler EX-5 | per 1 mole of silver 0.017 mole |
| Coupler EX-4 | per 1 mole of silver 0.003 mole |
| Coupler EX-6 | per 1 mole of silver 0.003 mole |

8th layer: Yellow filter layer

Gelatin layer comprising yellow colloidal silver and an emulsified dispersion of 2,5-di-t-octylhydroquinone in an aqueous gelatin solution.

9th layer: Low speed blue-sensitive emulsion layer

| | |
|---|---|
| silver bromoiodide emulsion (silver iodide: 6 mole %) | the amount of silver coated 0.07 g/m$^2$ |
| Coupler EX-7 | per 1 mole of silver 0.25 mole |
| Coupler EX-2 | per 1 mole of silver 0.015 mole |

10th layer: High speed blue-sensitive emulsion layer

| | |
|---|---|
| Silver bromoiodide emulsion (silver iodide: 6 mole %) | the amount of silver coated 0.6 g/m$^2$ |
| Coupler EX-7 | per 1 mole of silver 0.06 mole |

11th layer: First protective layer

| | |
|---|---|
| Silver bromoiodide (silver iodide 1 mole %, average grain size 0.07μ) | the amount of silver coated 0.5 g |

Gelatin layer containing an emulsified dispersion of an ultraviolet light absorbing agent UV-1

12th layer: Second

Gelatin layer containing trimethyl methacrylate particles of about 1.5 microns in diameter.

Gelatin hardening agent H-1 and/or surface active agent were added to each of the layers in addition to the compositions described above.

<The compounds used to prepare the compositions>

Sensitizing dye I:

anhydro-5,5'-dichloro-3,3'-di-(γ-sulfopropyl)-9-ethylthiacarbocyanine-hydroxide, pyridinium salt Sensitizing dye II:

anhydro-9-ethyl-3,3'-di-(γ-sulfopropyl)-4,5,4',5'-dibenzothiacarbocyanine-hydroxide, triethylamine salt Sensitizing dye III:

anhydro-9-ethyl-5,5'-dichloro-3,3'-ddi-(γ-sulfopropyl)oxacarbocyanine, sodium salt Sensitizing dye IV:

anhydro-5,6,5',6'-tetrachloro-1,1'-diethyl-3,3'-di-{β-[β-(γ-sulfopropyl)ethoxy]ethyl}imidazolocarbocyaninehydroxide, sodium salt

EX-1

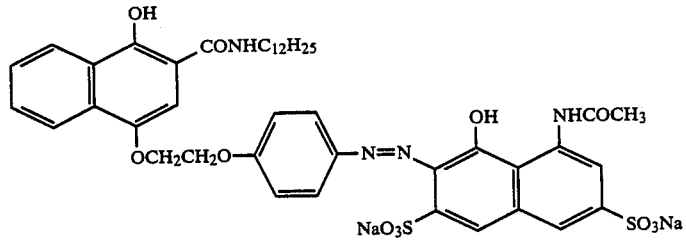

-continued
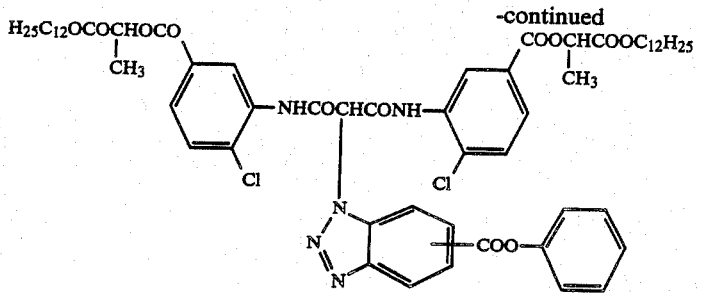
EX-2
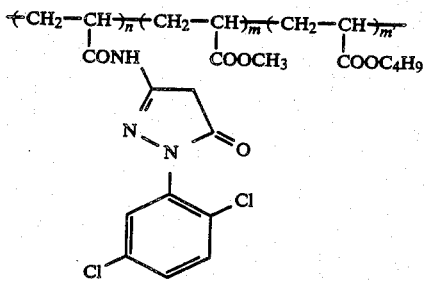
EX-3
(n/m + m' = 1 m/m' = 1 (Weight ratio)
Molecular weight: about 40,000)
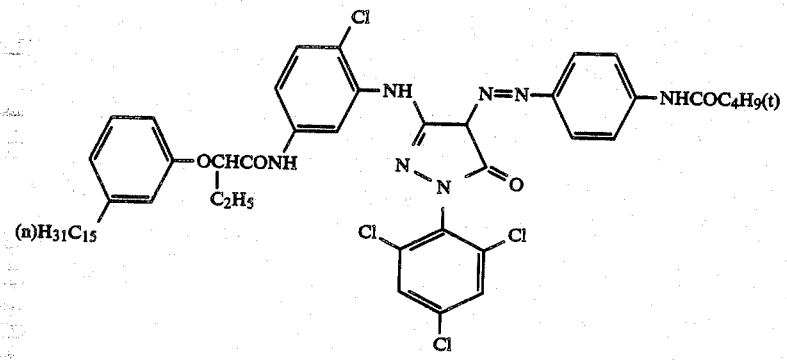
EX-4
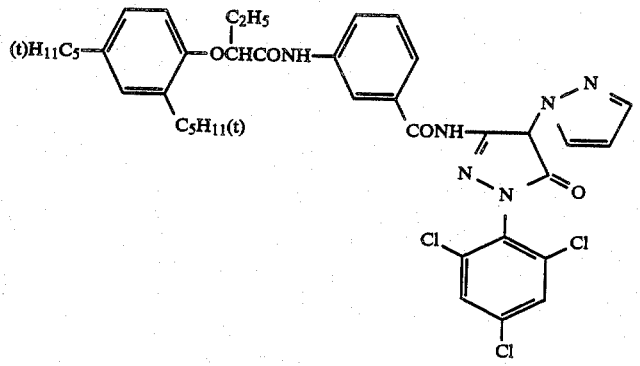
EX-5
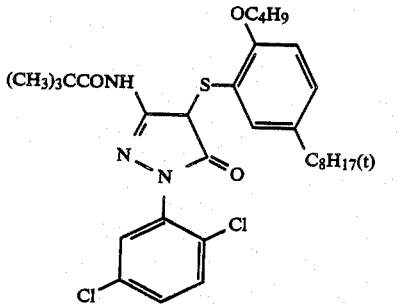
EX-6

-continued

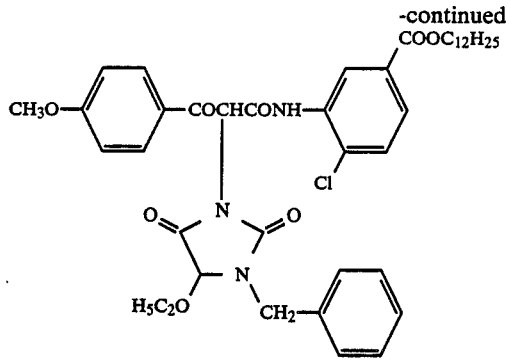

EX-7

$CH_2{=}CH{-}SO_2{-}CH_2{-}CONH{-}(CH_2)_2NHCOCH_2SO_2CH{=}CH_2$ H-1

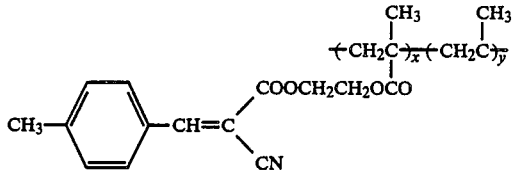

UV-1 x/y = 7/3 (Weight ratio)

The color negative films thus prepared were exposed to tungsten light at 25 cms (the color temperature of which had been adjusted to 4800° K. through a filter) through a wedge, followed by color development at 38° C. as follows:

| | |
|---|---|
| Process 1 (Comparative process) | |
| Color development | 3 min. 15 sec. |
| Bleaching | As described in Table 1 |
| Fixing | As described in Table 1 |
| Washing | 3 min. 15 sec. |
| Stabilizing | 1 min. 5 sec. |
| Process 2 (Comparative process) | |
| Color development | 3 min. 15 sec. |
| Blixing | As described in Table 1 |
| Washing | 3 min. 15 sec. |
| Stabilizing | 1 min. 5 sec. |
| Process 3 (Process of this invention) | |
| Color development | 3 min. 15 sec. |
| Bleaching | As described in Table 1 |
| Blixing | As described in Table 1 |
| Washing | 3 min. 15 sec. |
| Stabilizing | 1 min. 5 sec. |

The composition of each of the processing solutions used in the steps described above was as follows:

| | |
|---|---|
| Color developing solution | |
| Trisodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—β-hydroxyethylamino)-2-methylaniline sulfate | 4.5 g |
| Water to 1.0 l | pH 10.0 |
| Bleaching solution | |
| Ethylenediaminetetraacetic acid, ferric ammonium salt | 100.0 g |
| Ethylenediaminetetraacetic acid, disodium salt | 8.0 g |
| Ammonium bromide | 150.0 g |
| Ammonia water (28%) | 7.0 ml |
| Water to 1.0 l | pH 6.0 |
| Fixing solution | |
| Sodium tetrapolyphosphate | 2.0 g |

-continued

| | |
|---|---|
| Sodium sulfate | 4.0 g |
| Aqueous ammonium thiosulfate solution (70%) | 175.0 ml |
| Sodium bisulfite | 4.6 g |
| Water to 1.0 l | pH 6.6 |
| Blixing solution | |
| Ethylenediaminetetraacetic acid, ferric Ammonium salt | 100.0 g |
| Ethylenediaminetetraacetic acid, disodium salt | 4.0 g |
| Aqueous ammonium thiosulfate solution (70%) | 175.0 ml |
| Sodium sulfite | 4.5 g |
| Ammonia water | 15 ml |
| Water to 1.0 l | pH 6.8 |
| Stabilizing solution | |
| Formalin (40%) | 8.0 ml |
| (Polyoxyethylene para-monononylphenyl ether, 0.3 g/l | 5.0 ml |
| Water to 1.0 l | |

The minimum density, gradation and relative sensitivity of each of the film samples thus processed were measured. An amount of residual silver in the area of maximum color density was measured by X-ray fluorescence analysis.

Separately, the same film samples were processed by another process, FUJI COLOR PROCESS CN-16 of FUJI PHOTO FILM CO., LTD. (color development, 3 min. 15 sec.; bleaching, 6 min. 30 sec.; washing, 2 min. 10 sec.; fixing, 4 min. 20 sec.; washing, 3 min. 15 sec.; stabilizing, 1 min. 5 sec., followed by drying. Processing temperature was 38° C.), followed by the measurement of the minimum density, gradation and relative sensitivity of the processed samples. The results were compared with those obtained by the processes 1 to 3 described earlier.

The comparative results are shown in Table 1 by the differences between the specific values obtained by the processes 1 to 3 and those obtained by the control (CN-16 process). Minimum density values were omitted because they were not significantly different. Table 1 shows that the greater the absolute numerical values of gradation and relative sensitivity become, that is, the greater the differences from the results of the control process, the worse the photographic properties get.

The relative sensitivity and gradation were determined as follows:

Relative sensitivity:

The difference between the minimum density and the density at an exposure value which corresponds on the characteristic curve, to a density of 0.2 above the minimum density of the control sample.

Gradation:

The difference between the density at the exposure value as defined above and the density at an exposure value greater by 1.5 of logarithm than the exposure value as defined above.

Comparative compounds A, B and C as shown in Table 1 are cyan dye-forming couplers of the following formulas.

Comparative compound A

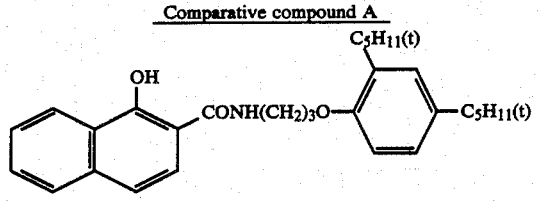

Comparative compound B

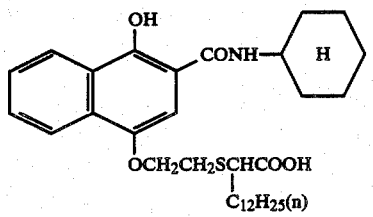

-continued

Comparative compound C

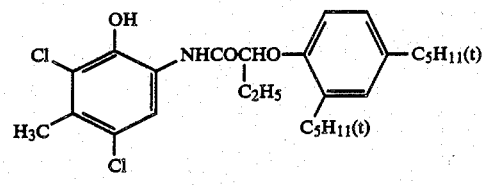

Table 1 clearly shows that the process of this invention enables de-silvering to a sufficient level for practical use in such a time, during which neither the bleaching-fixing process (Comparative sample Nos. 1 to 3) nor the single blixing process (Comparative sample Nos. 4 to 6) enables de-silvering sufficiently. As seen from the differences in the relative sensitivity and gradation between the control and the examples, the process of this invention gives good quality photographic reproductions without the formation of the leuco form of cyan dye. Even in this invention, when the time for de-silvering is shortened to 4 minutes (bleaching 1 min. 30 sec.; blixing 2 min. 30 sec.), the gradation and relative sensitivity of Red-sensitive layers are reduced on rare occasions as seen from the sample Nos. 13 and 14. However, it can generally be said that the process of this invention can be used in combination with the cyan dye-forming couplers of formulas I and II to ensure both de-silvering and excellent photographic reproductions.

TABLE 1

| | Sample No. | Cyan dye-forming coupler: Low speed red-sensitive emulsion layer | Cyan dye-forming coupler: High speed red-sensitive emulsion layer | Time for de-silvering: Bleaching | Time for de-silvering: Blixing | Time for de-silvering: Fixing | Residual silver ($\mu g/cm^2$) | Gradation B | Gradation G | Gradation R | Relative sensitivity B | Relative sensitivity G | Relative sensitivity R |
|---|---|---|---|---|---|---|---|---|---|---|---|---|---|
| Comparative Examples | 1 | Comparative compound A | Comparative compound B | 2 min. | none | 3 min. | 10.5 | +0.10 | +0.09 | +0.06 | +0.03 | +0.01 | ±0 |
| | 2 | Comparative compound C | Comparative compound B | " | " | " | 11.2 | +0.09 | " | +0.07 | +0.04 | +0.02 | +0.01 |
| | 3 | Compound C-28 | Comparative compound B | " | " | " | 10.8 | +0.10 | +0.08 | +0.05 | +0.03 | " | ±0 |
| | 4 | Comparative compound A | Comparative compound B | none | 5 min. | none | 24.1 | +0.11 | " | +0.04 | +0.02 | " | " |
| | 5 | Comparative compound C | Comparative compound B | " | " | " | 22.9 | +0.12 | " | " | " | +0.01 | " |
| | 6 | Compound C-28 | Comparative compound B | " | " | " | 23.6 | +0.10 | +0.09 | +0.05 | " | +0.03 | +0.01 |
| Examples of this invention | 7 | Comparative compound A | Comparative compound B | 2 min. | 3 min. | none | 2.2 | +0.01 | ±0 | ±0 | ±0 | ±0 | ±0 |
| | 8 | Comparative compound C | Comparative compound B | " | " | " | 2.3 | ±0 | " | +0.01 | " | " | " |
| | 9 | Compound C-28 | Comparative compound B | " | " | " | 2.5 | −0.01 | " | ±0 | " | " | " |
| | 10 | Compound C-28 | Compound C-28 | " | " | " | 2.2 | ±0 | +0.01 | " | +0.01 | " | " |
| | 11 | Compound C-6 | Comparative compound B | " | " | " | 2.3 | +0.02 | " | " | " | " | " |
| | 12 | Compound C-6 | Compound C-6 | " | " | " | 2.1 | ±0 | ±0 | −0.01 | ±0 | " | " |
| | 13 | Comparative compound A | Comparative compound B | 1 min. 30 sec. | 2 min. 30 sec. | none | 3.0 | " | −0.02 | −0.06 | " | −0.01 | −0.02 |
| | 14 | Comparative compound C | Comparative compound B | 1 min. 30 sec. | 2 min. 30 sec. | " | 3.1 | " | " | −0.05 | " | ±0 | " |
| | 15 | Compound C-28 | Comparative compound B | 1 min. 30 sec. | 2 min. 30 sec. | none | 2.9 | ±0 | ±0 | −0.01 | ±0 | ±0 | ±0 |
| | 16 | Compound | Compound | 1 min. | 2 min. | " | 3.2 | +0.01 | " | ±0 | +0.01 | " | " |

TABLE 1-continued

| Sample No. | Cyan dye-forming coupler: Low speed red-sensitive emulsion layer | Cyan dye-forming coupler: High speed red-sensitive emulsion layer | Time for de-silvering: Bleaching | Time for de-silvering: Blixing | Time for de-silvering: Fixing | Residual silver (μg/cm²) | Gradation B | Gradation G | Gradation R | Relative sensitivity B | Relative sensitivity G | Relative sensitivity R |
|---|---|---|---|---|---|---|---|---|---|---|---|---|
| | C-28 | C-28 | 30 sec. | 30 sec. | | | | | | | | |
| 17 | Compound C-1 | Comparative compound B | 1 min. 30 sec. | 2 min. 30 sec. | " | 3.3 | ±0 | " | " | ±0 | " | " |
| 18 | Compound C-6 | Comparative compound B | 1 min. 30 sec. | 2 min. 30 sec. | " | 2.8 | +0.01 | " | " | " | " | " |
| 19 | Compound C-6 | Compound C-6 | 1 min. 30 sec. | 2 min. 30 sec. | " | 3.5 | " | " | " | " | " | " |
| 20 | Compound C-15 | Comparative compound B | 1 min. 30 sec. | 2 min. 30 sec. | " | 3.0 | " | " | " | −0.01 | " | " |
| 21 | Compound C-29 | Comparative compound B | 1 min. 30 sec. | 2 min. 30 sec. | " | 3.1 | " | +0.01 | " | ±0 | " | " |
| 22 | Compound C-31 | Comparative compound B | 1 min. 30 sec. | 2 min. 30 sec. | " | 3.4 | ±0 | " | " | " | " | " |
| 23 | Compound C-36 | Comparative compound B | 1 min. 30 sec. | 2 min. 30 sec. | " | 2.9 | " | ±0 | " | " | " | " |
| 24 | Compound C-40 | Comparative compound B | 1 min. 30 sec. | 2 min. 30 sec. | " | 3.0 | " | " | " | " | " | " |
| 25 | Compound C-48 | Comparative compound B | 1 min. 30 sec. | 2 min. 30 sec. | " | 3.2 | " | " | " | " | " | " |

EXAMPLE 2

The color negative film sample No. 1 as described in Table 1 (cyan dye-forming couplers used are Comparative compounds A and B) was cut into a 35 mm-wide film which in turn was exposed through a wedge in a similar manner to that of Example 1, followed by processing according to the Process CN-16 using an automatic developing processor to prepare a control sample. Separately, the color negative film sample No. 1 was subjected to the Process 1 or 2 as described in Table 2 using the automatic developing processor.

TABLE 2

| Steps | Process-1 (Comparative): Temperature | Process-1 (Comparative): Time | Process-2 (This invention): Temperature | Process-2 (This invention): Time |
|---|---|---|---|---|
| Color development | 38° C. | 3 min. 15 sec. | 38° C. | 3 min. 15 sec. |
| Bleaching | " | 5 min. | " | 2 min. |
| Fixing | " | 3 min. | — | — |
| Blixing | — | — | 38° C. | 3 min. |
| Washing | 30° C. | 3 min. 15 sec. | 30° C. | 3 min. 15 sec. |
| Stabilizing | 38° C. | 1 min. 5 sec. | 38° C. | 1 min. 5 sec. |

It should be noted that the comparison was made under the same amount of time as bleaching in Process 1. That is, 5 minutes is the total time for bleaching and blixing in Process 2 as shown in Table 2.

The color negative films (35 mm-wide, 100 m-long per day) were used for outdoor photography, and were then subjected to the processings of Processes 1 and 2. Separately, the same color negative films were subjected to wedge-exposure once a day, followed by the processings of Processes 1 and 2. These procedures were carried out for ten successive days.

Compositions of the solutions and the replenishers used in Processes 1 and 2 are as follows:

| | Initial solution | Replenisher |
|---|---|---|
| **Color developing solution** | | |
| Sodium nitrilotriacetate | 1.0 g | 1.1 g |
| Sodium sulfite | 4.0 g | 4.4 g |
| Potassium carbonate | 30.0 g | 32.0 g |

-continued

| | Initial solution | Replenisher |
|---|---|---|
| Potassium bromide | 1.4 g | 0.7 g |
| Hydroxylamine sulfate | 2.4 g | 2.6 g |
| 4-(N—ethyl-N—β-hydroxyethyl-amino-2-methylaniline sulfate | 4.5 g | 5.0 g |
| Water to | 1.0 l | 1.0 l |
| | pH 10.0 | pH 10.2 |
| **Bleaching solution** | | |
| Ammonium bromide | 160 g | 176 g |
| Ethylenediaminetetraacetic acid, sodium ferric salt | 130 g | 143 g |
| Ethylenediaminetetraacetic acid, disodium salt | 10 g | 11.5 g |
| Ammonia water (28%) | 7 ml | 4 ml |
| Water to | 1 l | 1 l |
| | pH 6.0 | pH 5.7 |
| **Blixing solution** | | |
| Ethylenediaminetetraacetic acid, sodium ferric salt | 70 g | 70 g |
| Ethylenediaminetetraacetic acid, disodium salt | 4.0 g | 4.0 g |
| Aqueous ammonium thiosulfate solution (70%) | 175 ml | 200 ml |
| Sodium sulfate | 4.5 g | 4.5 g |
| Ammonia water (28%) | 12 ml | 13 ml |
| Water to | 1 l | 1 l |
| | pH 6.8 | pH 7.0 |
| **Fixing solution** | | |
| Sodium tetrapolyphosphate | 2.0 g | 2.0 g |
| Sodium sulfite | 4.0 g | 5.0 g |
| Aqueous ammonium thiosulfate solutton (70%) | 175 ml | 200 ml |
| Sodium bisulfite | 4.6 g | 5 g |
| Water to | 1 l | 1 l |
| | pH 6.6 | pH 6.6 |
| **Stabilizing solution** | | |
| Formalin (40%) | 5 ml | 7 ml |
| (polyoxyethylene para-monononylphenyl ether, 0.3 g/ | 5 ml | 7 ml |
| water to | 1 l | 1 l |

TABLE 3

| Processing Steps | Amount of Replenisher per 1 meter of film: Process 1 (Comparative) | Amount of Replenisher per 1 meter of film: Process 2 (This invention) |
|---|---|---|
| Color development | 40 ml | 40 ml |
| Bleaching | 15 ml | 15 ml |

TABLE 3-continued

| Processing Steps | Amount of Replenisher per 1 meter of film: Process 1 (Comparative) | Process 2 (This invention) |
|---|---|---|
| Fixing | 40 ml | — |
| Blixing | — | 40 ml |
| Stabilizing | 40 ml | 40 ml |

The amount of residual silver in the maximum color density area of the film samples which were subjected to the wedge-exposure, followed by the processings of Processes 1 and 2, was measured by X-ray fluorescence analysis. Photographic properties of the films thus processed were compared with those of the control sample. The differences in gradation and relative sensitivity between the samples and the control are as shown in Table 4.

Table 4 shows that in the process of this invention, a good de-silvering effect and good quality photographic reproduction were obtained and maintained for a long time even when the process was carried out using an automatic developing processor, whereas in the comparative process in which the time for bleaching was 5 minutes, the de-silvering effect and photographic reproduction became worse with time and no de-silvering was effected on the 10th day. Namely, the process of this invention provides stable de-silvering effect and good quality photographic reproduction which are superior to those provided by the comparative process in which the working time for bleaching was the same (5 minutes) as in the process of this invention.

EXAMPLE 3

The color negative film No. 10 as described in Table 1 was exposed through a wedge in a similar manner to that of Example 1, followed by color development at 38° C. according to the following steps.

| | |
|---|---|
| **Process 1 (Comparative)** | |
| Color development | 3 min. 15 sec. |
| Bleaching | The time as described in Table 5 |
| Fixing | The time as described in Table 5 |
| Washing | 3 min. 15 sec. |
| Stabilizing | 1 min. 5 sec. |
| **Process 2 (This invention)** | |
| Color development | 3 min. 15 sec. |
| Bleaching | The time as described in Table 5 |
| Blixing | The time as described in Table 5 |
| Washing | 3 min. 15 sec. |
| Stabilizing | 1 min. 5 sec. |

Compositions of the solutions used in the processes described above were the same as those described in Example 1, except that the bleaching solution contained a bleach accelerating agent (bleach accelerator) as shown in Table 5 in an amount as shown also in Table 5.

The amount of residual silver in the maximum color density area of each of the samples thus processed was measured by X-ray fluorescence analysis.

Table 5 shows that the addition of the bleach accelerating agent to the bleaching solution had an excellent effect on the process of this invention which comprises bleaching and blixing steps but it had only a small effect on the comparative process which comprises bleaching and fixing steps.

TABLE 4

| Process | Days of processing | Residual silver ($\mu g/cm^2$) | Gradation B | Gradation G | Gradation R | Sensitivity B | Sensitivity G | Sensitivity R |
|---|---|---|---|---|---|---|---|---|
| 1 (Comparative) | 0 (start) | 2.5 | +0.02 | ±0 | ±0 | ±0 | ±0 | ±0 |
| | 2 days | 3.3 | +0.02 | +0.01 | +0.01 | +0.02 | +0.01 | ± |
| | 5 days | 3.8 | +0.05 | +0.03 | +0.02 | +0.03 | +0.01 | ±0 |
| | 10 days | 5.8 (Incomplete de-silvering) | +0.08 | +0.05 | +0.03 | +0.03 | +0.02 | +0.01 |
| 2 (This invention) | 0 (start) | 2.2 | +0.01 | ±0 | ±0 | +0.01 | ±0 | ±0 |
| | 2 days | 2.7 | +0.02 | +0.01 | ±0 | ±0 | ±0 | ±0 |
| | 5 days | 2.5 | +0.02 | ±0 | ±0 | ±0 | ±0 | ±0 |
| | 10 days | 2.3 | +0.02 | +0.01 | ±0 | ±0 | ±0 | ±0 |

TABLE 5

| | Sample No. | Bleach accelerating agent: Compounds | An amount added (mole/l) | Time for de-silvering process: Bleaching | Blixing | Fixing | Residual silver ($\mu g/cm2$) |
|---|---|---|---|---|---|---|---|
| Comparative Example | 1 | None | None | 1 min. | None | 2 Min. 30 sec. | 38 |
| | 2 | (III) - (2) | $5 \times 10^{-3}$ | " | " | " | 32 |
| | 3 | (IV) - (1) | " | " | " | " | 30.5 |
| | 4 | (IV) - (2) | " | " | " | " | 33 |
| | 5 | (VII) - (1) | " | " | " | " | 34 |
| | 6 | (VIII) - (1) | " | " | " | " | 31.5 |
| This invention | 7 | None | None | 1 min. | 2 min. 30 sec. | None | 18.5 |
| | 8 | (III) - (2) | $5 \times 10^{-3}$ | " | " | " | 2.3 |
| | 9 | (IV) - (1) | " | " | " | " | 1.8 |
| | 10 | (IV) - (2) | " | " | " | " | 2.4 |
| | 11 | (VII) - (1) | " | " | " | " | 4.5 |
| | 12 | (VIII) - (1) | " | " | " | " | 3.8 |
| | 13 | (III) - (2) | $5 \times 10^{-3}$ | 30 sec. | 2 min. 30 sec. | " | 2.9 |
| | 14 | (IV) - (1) | " | " | " | " | 2.4 |
| | 15 | (IV) - (2) | " | " | " | " | 3.0 |
| | 16 | (VII) - (1) | " | " | " | " | 5.8 |
| | 17 | (VIII) - (1) | " | " | " | " | 5.2 |

EXAMPLE 4

The same film samples as those described in Example 1 were prepared in a similar manner to that of Example 1, except that the couplers used in the 3rd and 4th layers in Example 1 were replaced by the following couplers, respectively. 3rd layer: Low speed red-sensitive emulsion layer

| | |
|---|---|
| 3rd layer: Low speed red-sensitive emulsion layer | |
| Comparative compound A of Example 1 | per 1 mole of silver 0.04 mole |
| Coupler EX-1 | per 1 mole of silver 0.003 mole |
| Coupler EX-2 | per 1 mole of silver 0.0006 mole |
| 4th layer: High speed red-sensitive emulsion layer | |
| Comparative compound B of Example 1 | per 1 mole of silver 0.02 mole |
| Coupler EX-1 | per 1 mole of silver 0.0016 mole |

The film samples thus prepared were cut into 35 mm-wide film which was then exposed to tungsten light at 25 cms (the color temperature of which has been adjusted to 4,800° K. through a filter) through a wedge, followed by the processing according to FUJI COLOR PROCESS CN-16 of FUJI PHOTO FILM CO., LTD. (color development 3 min. 15 sec., bleaching 6 min. 30 sec, washing 2 min. 10 sec., fixing 4 min. 20 sec., washing 3 min. 15 sec., stabilizing 1 min. 5 sec., followed by drying; the processing temperature was 38° C.) using an automatic developing processor to prepare a control sample. Separately, the same film samples were exposed through a wedge, followed by the three different processings as described in Table 6 using the automatic developing processor at 38° C.

TABLE 6

| Process 11 (Comparative) | Process 12 (Comparative) | Process 13 (This invention) |
|---|---|---|
| Color development 3 min. 15 sec. | Color development 3 min. 15 sec. | Color development 3 min. 15 sec. |
| Bleaching 2 min. 10 sec. | Blixing 5 min. 25 sec. | Bleaching 2 min. 10 sec. |
| Fixing 3 min. 15 sec. | | Blixing 3 min. 15 sec. |
| Washing 3 min. 15 sec. | Washing 3 min. 15 sec. | Washing 3 min. 15 sec. |
| Stabilizing 1 min. 5 sec. | Stabilizing 1 min. 5 sec. | Stabilizing 1 min. 5 sec. |

Compositions of the solutions used in the processes described above were as follows:

| | |
|---|---|
| Color developing solution (Processes 11 to 13) | |
| Sodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—β-hydroxyethylamino)-2-methylaniline sulfate | 4.5 g |
| Water to | 1.0 l |
| | pH 10.0 |
| Bleaching solution (Processes 11 and 13) | |
| Ethylenediaminetetraacetic acid, ferric ammonium salt | 100.0 g |
| Ethylenediaminetetraacetic acid, disodium salt | 8.0 g |
| Ammonium bromide | 150.0 g |
| Ammonia water (28%) | 7.0 ml |

-continued

| | |
|---|---|
| Water to | 1.0 l |
| | pH 6.0 |
| Fixing solution (Process 11) | |
| Sodium tetrapolyphosphate | 2.0 g |
| Sodium sulfite | 4.0 g |
| Aqueous ammonium thiosulfate solution (70%) | 175.0 ml |
| Sodium bisulfite | 4.6 g |
| Water to | 1.0 l |
| | pH 6.6 |
| Blixing solution (Processes 12 and 13) | |
| Ethylenediaminetetraacetic acid, ferric ammonium salt | 100.0 g |
| Ethylenediaminetetraacetic acid, disodium salt | 4.0 g |
| Aqueous ammonium thiosulfate solution (70%) | 175.0 ml |
| Sodium sulfite | 4.5 g |
| Ammonia water (28%) | 15 ml |
| Water to | 1.0 l |
| | pH 6.8 |
| Stabilizing solution (Processes 11 to 13) | |
| Formalin (40%) | 8.0 ml |
| (Polyoxyethylene para-mononononylphenyl ether, 0.3 g/l | 5.0 ml |
| water to | 1.0 l |

Gradation and relative sensitivity of each of the samples thus processed and the control were measured. An amount of residual silver in the maximum color density area was measured by X-ray fluorescence analysis.

In Process 13, the upper part of the bleaching bath of the automatic developing processor was connected to the lower part of the blixing bath by a tube so that the overflow solution from the bleaching bath was introduced into the blixing bath when the replenisher is added to the bleaching bath. For ten successive days, the 35 mm-wide film (100 m per day) was used for outdoor photography, and was then subjected to the processing according to Process 13 while replenishing the following processing solutions. At the same time, the samples exposed through a wedge were also processed every day.

| | |
|---|---|
| <Amount of each of the solutions replenished per 1 meter of the 35 mm-wide film> | |
| Replenisher to the color developing bath | 40 ml |
| Replenisher to the bleaching bath | 20 ml |
| Replenisher (containing the fixing agent) to the blixing bath | 20 ml |
| Replenisher to the stabilizing bath | 40 ml |
| <Compositions of the replenishers> | |
| Replenisher to the color developing bath | |
| Sodium nitrilotriacetate | 1.1 g |
| Sodium sulfite | 4.4 g |
| Sodium carbonate | 32.0 g |
| Potassium bromide | 0.7 g |
| Hydroxylamine sulfate | 2.6 g |
| 4-(N—ethyl-N—β-hydroxyethylamino)-2-methylaniline sulfate | 5.0 g |
| Water to | 1.0 l |
| | pH 10.2 |
| Replenisher to the bleaching bath | |
| Ammonium bromide | 175.0 g |
| Ammonia water (28%) | 4.0 ml |
| Ethylenediaminetetraacetic acid, ferric ammonium salt | 110.0 g |
| Ethylenediaminetetraacetic acid, disodium salt | 10 g |
| Water to | 1.0 l |
| | pH 5.7 |
| Replenisher (containing the fixing agent) to the blixing bath | |
| Aqueous ammonium thiosulfate solution (70%) | 400 ml |
| Sodium sulfite | 9 g |
| Ammonia water (28%) | 12 ml |

-continued

| | |
|---|---|
| Sodium bisulfite | 10.2 g |
| Sodium tetrapolyphosphate | 4.4 g |
| Water to | 1.0 l |
| | pH 8.1 |
| Replenisher to the stabilizing bath | |
| Formalin (40%) | 9 ml |
| (Polyoxyethylene para-monononylphenyl ether, 0.3 g/ | 7 ml |
| water to | 1.0 l |

Results of the processings are as shown in Table 7.

TABLE 7

| | Process | Days of processing | Difference in relative sensitivity B | G | R | Difference in gradation B | G | R | Residual silver ($\mu g/cm^2$) |
|---|---|---|---|---|---|---|---|---|---|
| Comparative Example | 11 | 0 day (start) | +0.05 | +0.04 | −0.03 | +0.1 | +0.08 | −0.08 | 13.0 |
| Comparative Example | 12 | 0 day (start) | +0.05 | +0.06 | −0.04 | +0.12 | +0.10 | −0.12 | 27.5 |
| This invention | 13 | 0 day (start) | ±0 | ±0 | ±0 | ±0 | ±0 | ±0 | 2.1 |
| | | 10 days | +0.01 | ±0 | ±0 | +0.01 | ±0 | ±0 | 1.9 |

The difference in relative sensitivity and the difference in gradation as shown in Table 7 are differences between the control sample and the examples, respectively.

Table 7 shows that the process of this invention provides good quality photographic reproductions and good de-silvering in a shortened time, which are comparable to those obtained by the control process and that these effects of the process of this invention are long-lasting.

EXAMPLE 5

The procedure of Example 4 was repeated to prepare a 35 mm-wide film, except that Comparative compound A of Example 1 used in Example 4 was replaced by the coupler of the following formula:

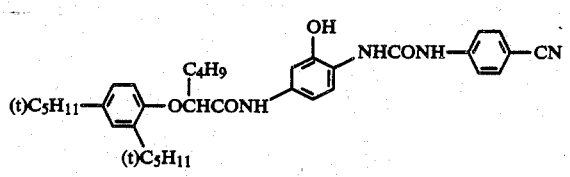

The color negative photographic element thus prepared was subjected to the same exposure through a wedge as described in Example 4, followed by the processing according to the Process CN-16 as described in Example 4 using the automatic developing processor.

Separately, the films exposed through a wedge were processed by Processes 14 and 15 as described in Table 8.

TABLE 8

| Process 14 (Comparative) | | Process 15 (This invention) | |
|---|---|---|---|
| Color development | 3 min. 15 sec. | Color development | 3 min. 15 sec. |
| Bleaching | 40 sec. | Bleaching | 40 sec. |
| Fixing | 3 min. 15 sec. | Blixing | 3 min. 15 sec. |
| Washing | 3 min. 15 sec. | Washing | 3 min. 15 sec. |
| Stabilizing | 20 sec. | Stabilizing | 20 sec. |

Various bleach accelerating agents were used in the processes as described in Table 8.

The processing solutions used in the processes of Table 8 were the same as those used in Processes 11 and 13 of Example 4, except for the following solutions:

| | |
|---|---|
| Bleaching solution | |
| Ethylenediaminetetraacetic acid, ferric ammonium salt | 100.0 g |
| Ethylenedieminetetraacetic acid, disodium salt | 8.0 g |
| Ammonium bromide | 80.0 g |
| Ammonia water (28%) | 7.0 ml |
| Bleach accelerating agent (as described in Table 9) | |
| Water to | 1.0 l |
| | pH 6.0 |
| Blixing solution | |
| The same as the bleaching solution described above except that any bleach accelerating agents were not contained | 500 ml |
| Aqueous ammonium thiosulfate solution (70%) | 175 ml |
| Sodium sulfite | 4.0 g |
| Sodium bisulfite | 4.6 g |
| Ammonia water (28%) | 6.0 ml |
| Sodium tetrapolyphosphate | 2.0 g |

For ten successive days, the 35 mm-wide films of the Example (100 m per day) were used for outdoor photography, and were then subjected to the processing according to Process 15, while replenishing the following processing solutions. At the same time, the samples exposed through a wedge were also processed every day.

The solution which overflowed from the bleaching bath when the replenisher was added thereto was introduced into the blixing bath in a manner similar to that of Example 4.

<Amount of each of the replenishers>

The same as in Example 4.

<Compositions of the replenishers>

The same as those used in Process 13 of Example 4, except for the following solutions.

| Replenisher to the bleaching bath | |
|---|---|
| Ethylenediaminetetraacetic acid, ferric ammonium salt | 110 g |
| Ammonium bromide | 90 g |
| Ammonia water (28%) | 4 ml |
| Ethylenediaminetetraacetic acid, disodium salt | 10 g |
| Bleach accelerating agent | As described in Table 9 |
| Water to | 1.0 l |
| | pH 5.7 |

The results of the processings are as shown in Table 9. Table 9 shows that the process of this invention provides good quality photographic reproduction and promotes the effect of the bleach accelerating agent to enable rapid de-silvering. Further, it shows that these excellent effects are long-lasting by the introduction of the overflow solution out of the bleaching bath to the blixing bath.

TABLE 9

| | Test No. | Process | Bleach accelerating agent: Compound | Concentration in the bleaching solution | Concentration in the bleaching replenisher | Days of processing |
|---|---|---|---|---|---|---|
| Comparative example | 21 | 14 | none | 0 | — | 0 (start) |
| | 22 | " | (I) - (2) | $5 \times 10^{-3}$ mole | — | " |
| | 23 | " | (II) - (1) | " | — | " |
| | 24 | " | (III) - (3) | " | — | " |
| This invention | 25 | 15 | none | 0 | — | 0 (start) |
| | 26 | " | (I) - (2) | $5 \times 10^{-3}$ mole | $6 \times 10^{-3}$ mole | 0 (start) 10 days |
| | 27 | " | (II) - (1) | $5 \times 10^{-3}$ mole | $6 \times 10^{-3}$ mole | 0 (start) 10 days |
| | 28 | " | (II) - (2) | $5 \times 10^{-3}$ mole | $6 \times 10^{-3}$ mole | 0 (start) 10 days |
| | 29 | " | (III) - (3) | $5 \times 10^{-3}$ mole | $6 \times 10^{-3}$ mole | 0 (start) 10 days |
| | 30 | " | (IV) - (1) | $5 \times 10^{-3}$ mole | $6 \times 10^{-3}$ mole | 0 (start) 10 days |
| | 31 | " | (VI) - (4) | $5 \times 10^{-3}$ mole | $6 \times 10^{-3}$ mole | 0 (start) 10 days |

| | Test No. | Residual silver ($\mu g/cm^2$) | Difference in gradation B | G | R | Difference in relative sensitivity B | G | R |
|---|---|---|---|---|---|---|---|---|
| Comparative example | 21 | 95.0 | +0.15 | +0.12 | −0.13 | +0.04 | +0.04 | −0.05 |
| | 22 | 92.3 | +0.15 | +0.14 | −0.12 | +0.05 | +0.03 | −0.06 |
| | 23 | 91.6 | +0.13 | +0.13 | −0.11 | +0.04 | +0.04 | −0.05 |
| | 24 | 93.0 | +0.15 | +0.12 | −0.10 | +0.06 | +0.05 | −0.04 |
| This invention | 25 | 18.5 | +0.05 | +0.04 | −0.03 | +0.02 | +0.02 | −0.02 |
| | 26 | 1.8 | ±0 | ±0 | ±0 | ±0 | ±0 | ±0 |
| | " | 1.6 | ±0 | ±0 | ±0 | ±0 | ±0 | ±0 |
| | 27 | 1.5 | ±0 | ±0 | ±0 | ±0 | ±0 | ±0 |
| | " | 1.5 | ±0 | ±0 | ±0 | ±0 | ±0 | ±0 |
| | 28 | 2.3 | +0.02 | +0.02 | ±0 | +0.02 | +0.03 | −0.02 |
| | " | 2.5 | +0.02 | +0.01 | +0.01 | ±0 | +0.01 | ±0 |
| | 29 | 2.6 | +0.01 | ±0 | ±0 | +0.01 | ±0 | ±0 |
| | " | 2.3 | +0.02 | +0.01 | ±0 | +0.02 | +0.01 | ±0 |
| | 30 | 3.6 | +0.03 | +0.02 | +0.01 | +0.02 | ±0 | ±0 |
| | " | 3.3 | +0.03 | +0.02 | ±0 | +0.02 | +0.01 | ±0 |
| | 31 | 2.9 | +0.02 | +0.02 | −0.02 | +0.01 | ±0 | −0.02 |
| | " | 3.1 | +0.03 | +0.02 | ±0 | +0.02 | ±0 | ±0 |

EXAMPLE 6

The photographic elements prepared according to Example 5 were subjected to exposure through a wedge in a similar manner to that of Example 4, followed by the Process CN-16 using the automatic developing processor to prepare a control sample.

For ten successive days, the photographic elements (100 m per day) were used for outdoor photography, followed by the processing according to Process 15 as described in Table 8 of Example 5, while replenishing the following processing solutions. At the same time, the samples exposed through a wedge were also processed every day. Pipework was set up so that the solution which overflowed out of the bleaching bath was introduced into the blixing bath.

<Compositions of the processing solutions>

Color developing solution and Replenisher
The same as described in Example 4.

| Bleaching solution and Replenisher | |
|---|---|
| Diethylenetriaminepentaacetic acid | 174 g |
| Ferric chloride hexa hydrate | 108 g |
| Ammonium bromide | 90 g |
| Ammonia water (37%) | 190 ml |
| Ammonium nitrate | 15 g |
| Bleach accelerating agent (Compound IV-1) | 2 g |
| Water to | 1.0 l |
| | pH 5.8 |
| **Blixing solution** | |
| The bleaching solution described above | 500 ml |
| Sodium sulfate | 10 g |
| Aqueous ammonium thiosulfate solution (70%) | 200 ml |
| Water to | 1.0 |
| | pH 7.3 |

Replenisher to the blixing bath

The same as described in Example 4.

Stabilizing solution and Replenisher

The same as described in Example 4.

Amounts of replenishers added

The same as described in Example 4.

The results are as shown in Table 10, which shows that the process of this invention provides good quality photographic reproduction and enables good de-silvering. Table 10 also shows that these effects of this invention are comparable to those of the control sample and are long-lasting.

TABLE 10

| Days of processing | Difference in relative sensitivity B | G | R | Difference in gradation B | G | R | Residual silver ($\mu g/cm^2$) |
|---|---|---|---|---|---|---|---|
| 0 (start) | +0.02 | +0.01 | −0.01 | +0.02 | ±0 | ±0 | 1.6 |
| 10 days | +0.01 | ±0 | ±0 | +0.02 | ±0.01 | +0.01 | 1.4 |

Differences in relative sensitivity and in gradation are between the sample of this invention and the control sample, respectively.

What we claim is:

1. A method for the processing of a silver halide color photographic element comprising imagewise exposing the element, color developing the exposed element, followed by desilvering, wherein the de-silvering step comprises processing the developed element in a bleaching bath containing a bleaching agent comprising an aminopolycarboxylic acid ferric ion complex salt and subsequently in a blixing bath containing a bleaching agent comprising an aminopolycarboxylic acid ferric ion complex salt and a fixing agent.

2. The method of claim 1, wherein the silver halide color photographic element contains at least one cyan dyeforming coupler represented by the formula (I) or (II):

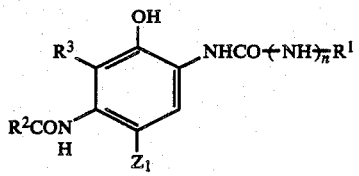
(I)

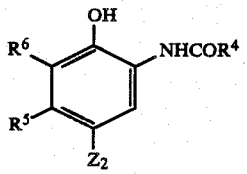
(II)

wherein $R^1$, $R^2$ and $R^4$ represent a substituted or unsubstituted aliphatic, aryl or heterocyclic group, $R^3$ and $R^6$ represent hydrogen atom, a halogen atom, a substituted or unsubstituted aliphatic, aryl or acylamino group, or $R^3$ and $R^2$ represent together a non-metallic atom group which forms a nitrogen-containing five or six member ring, $R^5$ represents a substituted or unsubstituted alkyl group, $Z_1$ and $Z_2$ represent hydrogen or a group which can be released at the time of an oxidative coupling reaction with a developing agent, and n represents 0 or 1.

3. The method of claim 1, wherein the bleaching bath contains at least one bleach accelerator selected from the group consisting of compounds having a mercapto group or a disulfide linkage, isothiourea derivatives and thiazolidine derivatives.

4. The method of claim 1, wherein solution overflowed from the bleaching bath is introduced into the blixing bath.

5. The method of claim 1, wherein the bleaching agent is contained in the bleaching bath in a concentration of 0.1 to 1.0 mole/l.

6. The method of claim 1, wherein the bleaching agent is contained in the blixing bath in a concentration of 0.05 to 0.5 mole/l.

7. The method of claim 1, wherein the blixing agent is contained in the blixing bath in a concentration of 0.3 to 3 mole/l.

8. The method of claim 1, wherein the time for bleaching is 20 seconds to 4 minutes and the time for blixing is 1 to 5 minutes.

9. The method of claim 2, wherein the cyan dyeforming coupler is incorporated in the element in the amount of $2\times10^{-3}$ to $5\times10^{-1}$ mole per mole of silver.

10. The method of claim 3, wherein the bleach accelerator is selected from the compounds represented by the formula (III), (IV), (V), (VI), (VII), (VIII) or (IX):

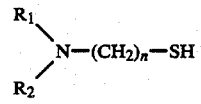
(III)

wherein $R_1$ and $R_2$ may be the same or different and represent hydrogen atom, substituted or unsubstituted lower alkyl or acyl or $R_1$ and $R_2$ may form a ring together and n is 1, 2 or 3,

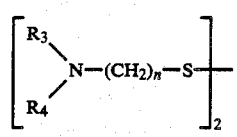
(IV)

wherein $R_3$ and $R_4$ represent substituted or unsubstituted aliphatic, aryl or heterocyclic group, or $R_3$ and $R_4$ may form a ring together and n is 1, 2 or 3.

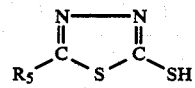
(V)

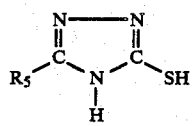
(VI)

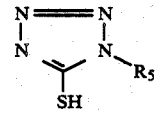
(VII)

wherein $R_5$ represents hydrogen atom, halogen atom such as chlorine or bromine, amino, substituted or unsubstituted lower alkyl, or alkyl-containing amino group,

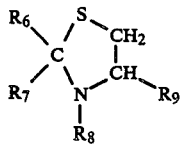

(VIII)

wherein $R_6$ and $R_7$ may be the same or different and each represents hydrogen atom, substituted or unsubstituted alkyl, substituted or unsubstituted phenyl or substituted or unsubstituted heterocyclic, $R_8$ represents hydrogen atom or substituted or unsubstituted lower alkyl and, $R_9$ represents hydrogen atom or a carboxyl group, and

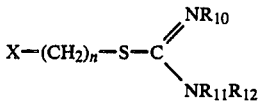

(IX)

wherein $R_{10}$, $R_{11}$ and $R_{12}$ may be the same or different and each represents hydrogen atom or lower alkyl or, $R_{10}$ and $R_{11}$ or $R_{12}$ may form a ring together, and X represents amino, sulfonic or carboxyl group which may contain one or more substituents.

11. The method of claim 10, wherein the bleach accelerator is contained in the bleaching bath in a concentration of $1\times10^{-5}$ to $1\times10^{-1}$ mole/l.

12. The method of claim 1, wherein the silver halide incorporated in the color photographic element comprises silver iodide in an amount of 15 mole % or less.

13. The method of claim 1, wherein the color photographic element contains at least 3 g of silver per square meter of the element.

14. The method of claim 13, wherein the color photographic element contains 3 to 15 g of silver per square meter of the element.

* * * * *